US006209644B1

(12) United States Patent
Brunet

(10) Patent No.: US 6,209,644 B1
(45) Date of Patent: Apr. 3, 2001

(54) ASSEMBLY AND METHOD FOR FORMING A SEAL IN A JUNCTION OF A MULTILATERAL WELL BORE

(75) Inventor: Charles G. Brunet, Houston, TX (US)

(73) Assignee: Weatherford Lamb, Inc., Houston, TX (US)

( * ) Notice: Subject to any disclaimer, the term of this patent is extended or adjusted under 35 U.S.C. 154(b) by 0 days.

(21) Appl. No.: 09/277,929

(22) Filed: Mar. 29, 1999

(51) Int. Cl.[7] ..... E21B 7/08
(52) U.S. Cl. ..... 166/297; 166/117.6
(58) Field of Search ..... 166/117.5, 117.6, 166/297, 298, 313, 384

(56) References Cited

U.S. PATENT DOCUMENTS

| | | | | |
|---|---|---|---|---|
| 5,322,127 | * | 6/1994 | McNair et al. | 166/313 |
| 5,730,224 | * | 3/1998 | Williamson et al. | 166/386 |
| 5,735,350 | * | 4/1998 | Longbottom et al. | 166/313 |
| 5,944,108 | * | 8/1999 | Baugh et al. | 166/313 |
| 6,009,949 | * | 1/2000 | Gano et al. | 166/313 |

* cited by examiner

*Primary Examiner*—Frank Tsay
(74) *Attorney, Agent, or Firm*—Parks & Associates P.C.

(57) ABSTRACT

This invention relates to an assembly and method for forming a hydraulic seal at the junction of a multilateral well bore drilled through a window in at least a main well bore comprising a tubular member which is run into the well bore casing and has a sealing member positioned about the tubular member for seating, at least one orientation member being provided for orientation of the tubular member and sealing member in the main well bore casing, and having a tubular sleeve member for insertion in the well bore which has an aperture through at least one side of the tubular sleeve member for alignment of the aperture with the window and having a seating surface on the inside of the tubular sleeve member proximate the aperture, with the aperture in some embodiments being adjustable, and having a deflection member positioned and releasable sealed in the tubular sleeve member for deflecting the tubular member through the window in the well bore when the tubular member is run into contact with the deflection member, and having at least one orientation member for orientation of the deflection member relative to the window in the at least well bore casing and for aligning the aperture in the tubular sleeve with the window and a method of using the assembly to form a seal at the junction which can be executed in one run into the well bore casing in at least one embodiment.

33 Claims, 10 Drawing Sheets

ASSEMBLY AND METHOD FOR FORMING A SEAL IN A JUNCTION OF A MULTILATERAL WELL BORE

FIELD OF INVENTION

This invention relates to an assembly and method to be used in the formation of seals at the junction of lateral wells drilled through windows in a main well bore casing or through any tubular type materials. Specifically this invention relates to novel and improved assemblies and methods used for forming seals in any deviated well bore which is drilled off or from another well bore whether it is vertical, deviated or horizontal and whether it is the primary well bore casing or other tubular material. More specifically this invention relates to the completion procedures used in completion of wells with deviated well bores off a main or casing well bore where as part of the completion procedure the well may be cemented and sealed.

BACKGROUND OF THE INVENTION

The drilling and completion of horizontal wells in recent years has offered dramatic improvements in the production of hydrocarbons and their recovery from the formations in which they are found. Although horizontal wells have been known for many years, it has only been in the last decade that this technology has been accepted by the industry and used as a proven and cost effective means to increase production and maximize ultimate recovery of hydrocarbons from a reservoir formation while lowering the cost to do so. As the industry has come to realize, horizontal wells frequently improve production by factors of 5 to 10 time in suitable reservoirs, such as for example those which are located in naturally fractured areas or are in heavy oil application zones.

Because of the improved economics in both the cost of production and the ultimate recovery of hydrocarbons reserves associated with horizontal drilling generally, many areas of the world have adopted such drilling techniques over the older technique of just drilling vertical wells. As horizontal and multilateral wells generally minimize the number of well locations and infrastructure required to develop an oil and gas field, this technique has become particularly important in high cost or environmentally sensitive areas, such as offshore locations, where reducing the number of platforms often results in significantly reduced investment and lower operational costs. Other areas for drilling which have adopted the use of laterals or multilateral which are particularly useful for horizontal development include reservoirs in urban areas, wildlife preserves, and permanent frost zones.

Multilateral wells are becoming increasingly important both from the standpoint of drilling a new well or for reworking an existing well to improve productivity and maximize the recovery of hydrocarbon reserves in place. Thus the use of multilateral wells have been accepted in reservoirs were horizontal drilling allows optimization of hydrocarbon recovery as for example in water drive systems which allow water injection efficiency to be increased and in the development of thin, or stacked reservoirs which would otherwise require many vertical wells, and in well as reservoirs with coning problems where by using horizontal drilling allows laterals to be optimally spaced for the fluid contact.

The incentives of cost effectiveness and environmental soundness, have expanded the use of multilateral or horizontal wells to be used in both the development of new wells and for re-entry of existing wells in established fields for stimulation and workover activities. Further the industry in its search for the most cost effective means to produce hydrocarbons with the least environmental impact has turned to multilateral and horizontal wells in great numbers.

The reasons are simple, as to why the industry has turned to multilateral wells, because in using multilateral wells drilled off a single main well bore, only one single main well bore is needed to be drilled and the additional recovery from the well is achieved by drilling laterals from the one single main well bore. However as the industry has placed ever increasing dependence on S0 multilateral well completion, there has been greater demand within the industry for advancing the technical capabilities of the multilateral technology. For example in completions systems and technology for the installation of lateral junctions in certain formations which are well known, there has been a primary barrier to the increased use of multilateral technology. This barrier has been the limitations in the completion options available, particularly in those situations in which a sealed junction is required to effectively produce a reservoir. Situations, such as those in which a hydraulically sealed lateral junction are desired, include unconsolidated or weakly consolidated formations, in order to avoid collapse of the junction, or in those junctions in which water injection is planned, or when the influx of formations fluids into the primary casing is unacceptable. These are just some of the situations which the current technology has not been able to over come on a consistent basis, except with the most expensive technologies in use today.

Further the technology which has only recently become available for the formation of junctions with hydraulic integrity is often too expensive to allow its utilization in all but the large budget wells, such as those found in offshore locations. At the present time, this sealed completion technology is generally not accepted as reliable by the industry for the average budget well. This has resulted in potentially high economic risk to install such systems. In addition, these completion systems may not allow the capability to selectively re-enter these laterals at a future time, nor to pressure test the junction for hydraulic integrity prior to the removal of the installation tools.

The prior art until the mid-1990's did not typically have a liner laid in a lateral and therefore these laterals were not tied back to the main well bore which severely limited or made impossible the re-entry of these laterals when workovers or cleanouts were required. However, subsequently, it became increasingly popular to case the laterals, as well as to tie back these laterals to the main well bore, but this tie back technology though making it easier to re-enter the well did not allow the junction to be hydraulically sealed to a significant pressure, such as 1,000 psi or more.

Also in the prior art where some sealing was able to be obtained it usually required multiple trips to install and perfect the seal, often 3 or more. This resulted in great expense in rig and personnel time, particularly in those high cost locations, such as offshore areas, which meant that many wells could not afford the technology and thus those wells could not receive the benefit of the multilateral technology.

Moreover, these earlier prior art systems did not allow the hydraulic integrity of the completed junction to be tested, and/or possibly repaired, prior to removing the tools used to install the seal. This was especially important in the high cost locations because of the excess expense in remobilization of the rig equipment and personnel for re-tripping back into the hole to bring the seal up to the design criteria determined necessary.

The prior art in many cases had to leave a packer in the main well bore in order to even attempt the re-entry back into the lateral well bore, which thus placed an obstruction or limit on the access to the main well bore below the packer. This forced well operators to have to make an election of which way they wanted to go and limited the number of lateral which could be drilled off on main well bore, if they elected to leave the packer in place in the main well bore.

Further, the prior art is legion with patents attempting to solve the problems of providing a reliable completion of a multilateral well such as U.S. Pat. No. 2,397,070 which describes a lateral well bore completion using flexible casing together with a movable gate for closing off the lateral. Of a similar nature is U.S. Pat. No. 2,797,893, which discloses a method for completing lateral wells using a flexible liner and a deflecting tool.

Several other prior patents such as U.S. Pat. No. 5,318,122 attempted to accomplish seals using a deformable device that selectively seals the juncture between the vertical and lateral wells using an inflatable mold which utilized a hardenable liquid to form a seal in conjunction with an expandable memory metal device or other devices for plastically deforming a sealing material to form a seal.

Such patents as U.S. Pat. No. 5,787,987 attempted to form a seal in the joint between the window in the well bore casing and the tubing being run into the lateral, by attempting to use the inside surface of the well bore casing as the sealing surface in conjunction with the flange being put into the well to seat with it. The sealing surface about the well bore casing does not provide as high of quality seal because of the material of the well bore casing not being a material which has been prepared for the purpose of forming a seal. Once in place then another run would be made into the well to put in place a sleeve to wedge the flange against the inside wall of the well bore about the window to form the seal. In this patent the old problem of multiple runs into a well to achieve a seal in the window section again shows up.

Further such art of a general nature including U.S. Pat. Nos. 2,452,920, 4,402,552, 5,289,876, 5,301,760, and U.S. Pat. No. 5,474,131 provided yet more examples of the teaching of the prior art which attempted to solve the problems in this art without the results which are achieved by the invention of this patent.

OBJECTS OF THE INVENTION

This invention is most broadly related to an assembly and method for forming a seal at the junction of a lateral well bore drilled through a window in a main well bore casing, or any other tubular material which has a window section formed therein such that a hydraulic seal is formed between the junction of the vertical and lateral well, and further that a sealed isolation zone is created between the respective lateral wells in a multilateral well system.

More specifically this invention comprises a tubular member for being run into the well bore casing or other tubular material, having at least one orientation member for orientation of the tubular member in the main well bore casing, with the tubular sleeve member having an aperture through it for being run into the well bore casing for alignment of its aperture with the window in the well bore casing. Further this assembly has a seating surface on the inside of the tubular sleeve member proximate the aperture. Also a sealing member is positioned about the tubular member for seating with the seating surface inside the tubular sleeve means proximate the aperture in the tubular sleeve member and for forming a seal when brought into engagement with the sealing member as the tubular means is run into the well bore and the lateral well bore. A deflection member positioned and releasably sealed in the tubular sleeve for deflecting the tubular means through the window, and functionally connected to the at least one orientation member for orientation of the deflection member relative to said window in the well bore casing for defecting the tubular means through the window and for aligning the aperture through the one side of the tubular sleeve member with the window in the main well bore casing. In further aspects of this invention the object of providing an assembly and method for providing the ability to re-enter the lateral wells would be provided, and the capability to pressure test, and repair, if necessary the junction for hydraulic integrity prior to the removal of the installation tools from the well would be provided, the capability to perform the afore mentioned in a single drill pipe trip in order to reduce the cost of such sealed lateral completions to make the use of this technology economical for lower producing wells, and the capability to install the completion assembly in a single trip into the well bore would be achieved.

It is the object of this invention to over come some of the deficiencies, drawbacks and shortcomings in the prior art which are discussed above by the usage of the assembly and methods of the invention disclosed herein.

In that regard it is an object of this invention to provide the assembly and methods to form and establish hydraulic integrity of a junction at a window downhole between a main casing and a lateral well bore for the purpose of preventing fluids from migrating into or out of the casing through this junction.

It is a further object of this invention to provide the apparatus and methods to establish hydraulic integrity of the junction between a main casing or other tubular material and the lateral which is relatively simple and inexpensive to install which makes it suitable for use in moderate producing wells, which generally have smaller budgets.

Also it is an object of this invention to provide control orifices which can be used to selectively re-enter the lateral at a future time without the need for a packer device or other orientation members being required to remain in the main well bore as an obstruction in the main well bore after the sealing means is installed in the junction.

Yet another object of this invention is to provide a tight pressure seal above and below the window in the main casing, as well as a tight hydraulic seal all around the window in order to prevent the migration of fluids either into or out of the main well bore casing or tubular member, which in some cases would be a lateral well liner.

A further object of this invention is to generally use a compression seal member to achieve the tight pressure seal above and below the window opening in the main well bore casing, as well as the tight hydraulic seal all around the window opening to prevent the migration of fluids either into or out of the main well bore casing or tubular member, which in some cases would be a lateral well liner.

Also a further object of this invention is to provide a compression sealing member for creation of a seal between the tubular sleeve member in the main well bore casing and the tubular member, or production liner in some cases, in order to prevent the migration of fluids either into or out of the main well bore casing or tubular member.

Yet a further object of this invention is to provide a compression sealing member for receiving sufficient fluid to expand the compression sealing member to create a seal between the compression sealing member and the tubular sleeve member in the main well bore casing in order to prevent the migration of fluids wither into or out of the main well bore casing or tubular member, which may be a production liner.

A further object of this invention is to provide a sealing member for seating with the a seating surface inside the tubular sleeve member proximate the aperture through the one side of the tubular sleeve member, and moved into engagement with the seating surface for preventing the migration of fluids either into or out of the main casing or production liner.

Also an object of this invention is to provide a method to pressure test the multilateral junction subsequent to the installation of the sealed completion but prior to the removal of the tubular member running tool from the well bore, and thus allow a great cost savings compared to re-mobilizing the rig and operating personnel if it is discovered at a future time that the required pressure integrity does not exist.

Yet a further object of this invention is to provide a means to repair the seal created in the junction, if necessary, prior to the removal of the tubular member running tool from the main casing well bore, and thus realize a great cost savings as opposed to re-mobilizing a rig and operating personnel if it is found that the required pressure integrity was not obtained.

Also an object of this invention is to provide a deflection member with in the tubular sleeve member which deflects the tubular member or production liner through the window and into the lateral without the requirement for a separate drill pipe trip to install the deflector member.

A further object of this invention is to provide a deflection member which is positioned and releasable sealed inside the tubular sleeve member which provides hydraulic integrity prior to the establishment of the seal at the junction but when removed leaves the tubular sleeve member substantially open for access down the main well bore casing.

Yet another object of this invention is to provide at least one orientation member for orientation of said deflector member and for aligning the aperture through the tubular sleeve with the window and for operating in conjunction with the deflector member and tubular sleeve both of being set in the main well bore casing and in the removal from the main well bore casing to leave a clear well bore, which is unrestricted.

Also an object of this invention is to provide an orientation member, having spring loaded key located on the tubular sleeve member which pop open into a key way located in the main casing window to allow the tubular sleeve member be aligned with the window and to align the aperture through the one side of the tubular sleeve member with the window by following the window sill as it moves downward until it is properly aligned, thus eliminating the need for a packer device or other obstruction to remain in the main well casing bore that would restrict or prohibit access to the well bore below the obstruction.

Yet a further object of this invention to use the one orientation means for orientation of the deflection member to also actuate slip devices which provide a means to hold the tubular sleeve member in a set and fixed position and to also set a seal between the main well bore casing and the tubular sleeve member to seal the main well bore casing below the seal member when the orientation member has been fully oriented and set.

Also an object of the invention is to allow the deflector member located within the sleeve device to be recovered with a single trip of the drill string or wire line after the installation of the sealed multilateral junction is completed.

A yet further object of this invention is to provide an assemblies and methods to establish hydraulic integrity at the junction of a multilateral well bore in a single trip of the drill string, while greatly reducing the cost of this installation due to the saving in rig time.

Yet further and additional benefits and improvements or the invention will be appreciated by other skilled in the art and those advantages and benefits of the invention will become apparent to those skilled in the art upon a reading and understanding of the following detailed description and drawings.

DESCRIPTION OF PREFERRED EMBODIMENTS

Figure 1A:
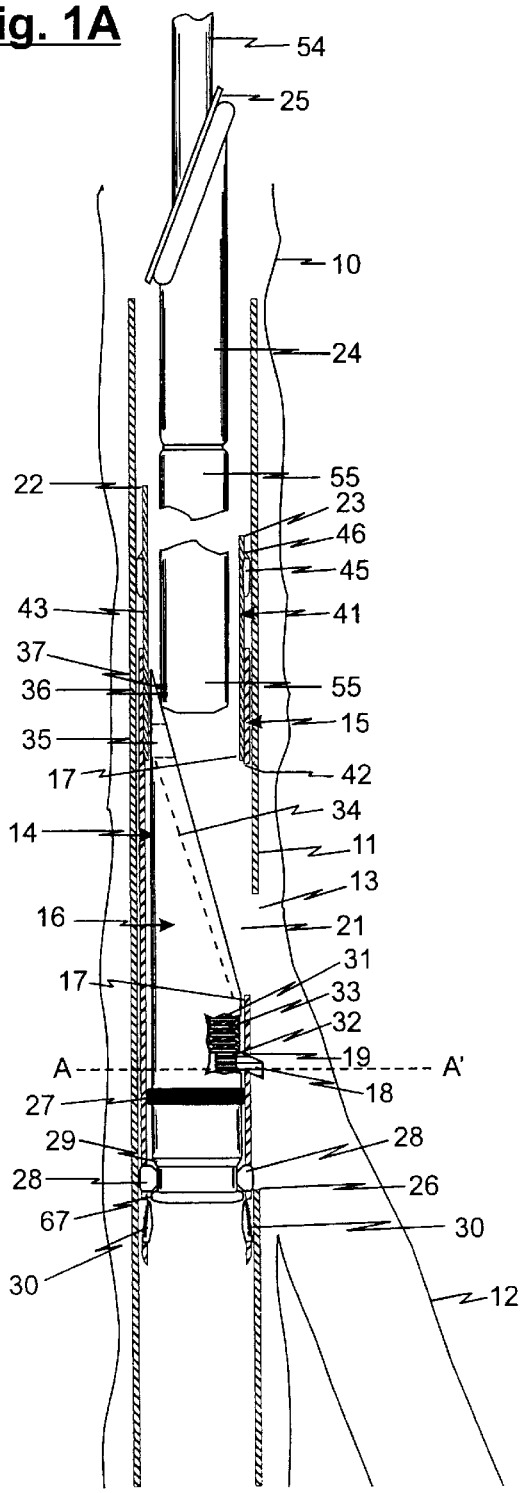
FIG. 1A is a side elevation view in partial cross section of the assembly of this invention for forming a seal at the junction of a lateral well bore drilled through a window in the main well bore casing as the assembly is being lowered down hole pasted the window with the key member popped outward into the window opening.

Referring now to FIG. 1A wherein a representational main well bore is generally shown as with a main well bore casing shown at 11, it should be understood all through out the teachings of this invention that while the drawings and discussion about the preferred embodiments may refer to vertical for the main well bore 10 or main well bore casing 11, they, in fact, may be in a vertical position, or deviated therefrom, or a horizontal position, without departing from the teachings of this invention. Further it should be understood that the references to up hole and down hole as shown in the drawings and discussions about the preferred embodiment, may, in fact, in the ground be horizontal on occasions or even have up hole and down hole reversed, but the general teaching is that up hole mean back toward the surface of the ground and downhole means into the hole in the opposite direction from up hole whether it is down hole or not in the well. Similarly the term lateral well bore or a multilateral well bore may or may not be truly lateral or horizontal but may be just more deviated than the main well bore 10 from which it is "kicked off from" but it will be generally referred to as a lateral well bore 12 or a multilateral in the teaching of this invention never the less.

It should also be understood that while the preferred embodiments shown make reference to main well bore and main well bore casing, in fact any tubular product from which a lateral or multilateral drilling of a bore could be achieved could be used in the practice of this invention. Thus it could be used in the well bore of a lateral to drill another lateral well without deviating from the teachings of this invention. It could be used with coiled tubing to drill a lateral well from the coiled tubing which might be the equivalent of the main well bore casing or it may be a lateral well from which an additional lateral might be drilled without departing from the teachings of this invention.

Referring more specifically to FIG. 1A, the assembly for forming a seal at the junction of a lateral well bore 12 drilled through a window 13 is generally shown as 14. In this particular FIG. 1A the assembly 14 is shown being lowered down hole in the main well bore casing 11, which has the window 13 in a section of the casing already in place in the main well bore casing 11. It should be understood that this window 13 could have been added to the make up of the casing string or it could have been milled down hole in place, either of which would not effect the practice of this invention, which makes this invention have universal application.

Figure 6:
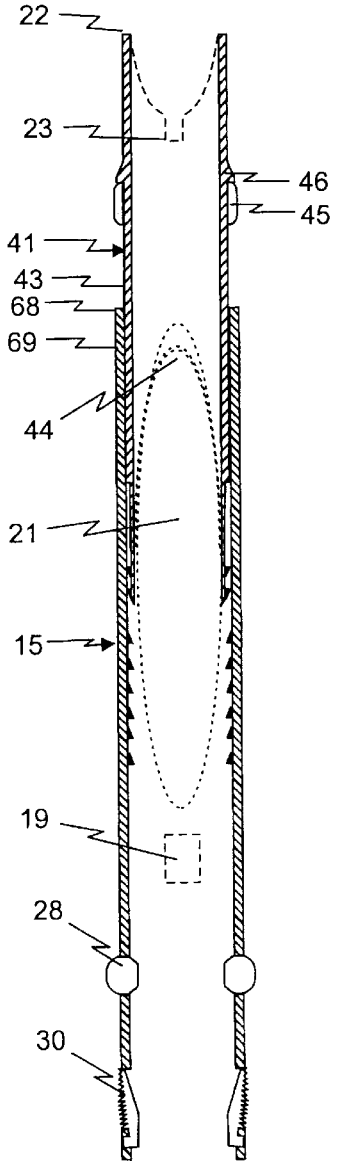
FIG. 6 is a partial cross section front view of the tubular sleeve member with the controllably collapsible upper part in view and uncollapsed.
Figure 7A:
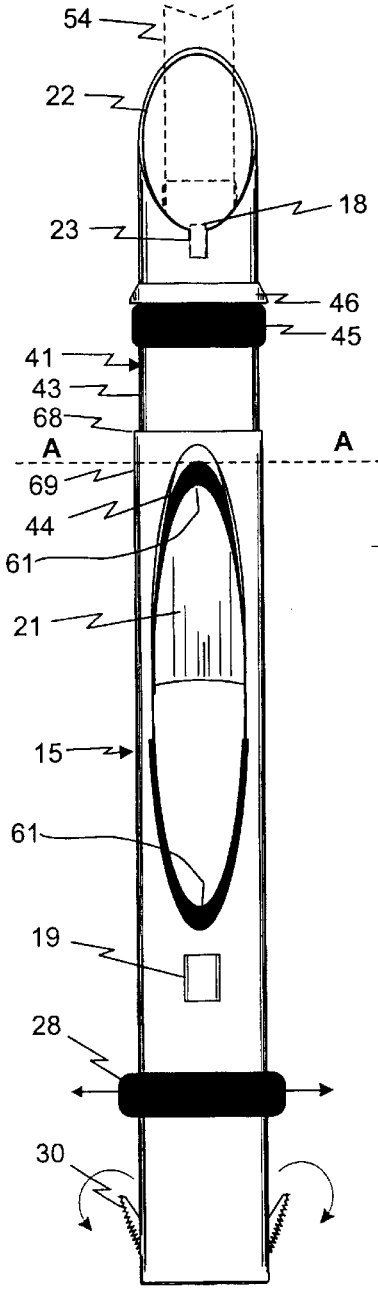
FIG. 7A is a front elevation view of the tubular sleeve member with the orientation member for the tubular member and key in phantom view at a first position prior to the controlled compression of the upper tubular sleeve member but with the seal on the down hole end formed and slip grabbing members set.
Figure 7B:
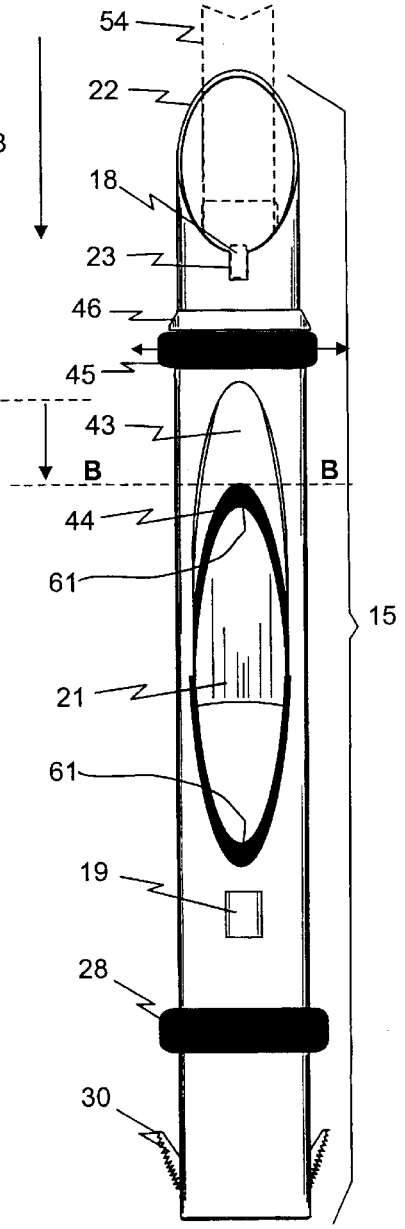
FIG. 7B is a front elevation view of the tubular sleeve member with the orientation member for the tubular and key in phantom view at a second position after the controlled Compression of the upper tubular sleeve member and with the upper seal set.

As can be seen in FIG. 1A this assembly 14, at least in this embodiment, comprises generally a tubular sleeve member 15 with a releasablely sealed deflection member 16, sometimes referred to as a "Whip Stock", positioned in the tubular sleeve member 15. The tubular sleeve member 15 is provided with an aperture 21, as best seen in FIGS. 6, 7A, and 7B, through at least one side of the tubular sleeve member 15 which can be brought into alignment with the window 13 when the tubular sleeve member 15 is run into the main well bore casing 11 and has a seating surface 17, shown in FIGS. 5A, 5B, & 5C, and 8 inside the tubular sleeve member 15 which is proximate the aperture 21. The deflection member 16 has an outwardly biased key 18 which when being run in is the main well bore casing 11 is compressed back into the deflection member 16 through a key hole 19 in the tubular sleeve member 15. When however, because the assembly 14 is rotated in the main well bore casing 11 as it is let down hole, the outward biased key 18 arrives at the window 13 in the main well bore casing 11, the key 18 will pop outwardly into the window 13 and catch on the sill 20 of the window 13. This catching on the sill 20 of the window 13 by key 18 provides an operator on the surface with the knowledge that the assembly 14 has found the window 13 and will be properly oriented once the operator just lowers the assembly 14 straight down hole, because the outwardly biased key 18 which popped outwardly into the window 13 will follow the window sill 20 of the window 13, as best seen in FIGS. 2A thru 2F, to the down hole end 52 of the window 13 or into a window key way 26 into proper orientation for alignment and positioning the aperture 21 with the window 13 of the main well bore casing 11. Also shown in FIGS. 1A and 1B, and additionally in FIGS. 6, 7A and 7B the tubular sleeve member 15 has on it's up hole end a tubular mule shoe 22 which will provide mechanical guidance into a mule shoe key way 23 which is also formed in the up hole end of the tubular sleeve member 15 for orientation of yet another part of the assembly 14 of this invention, which will be further explained later.

Figure 1B:
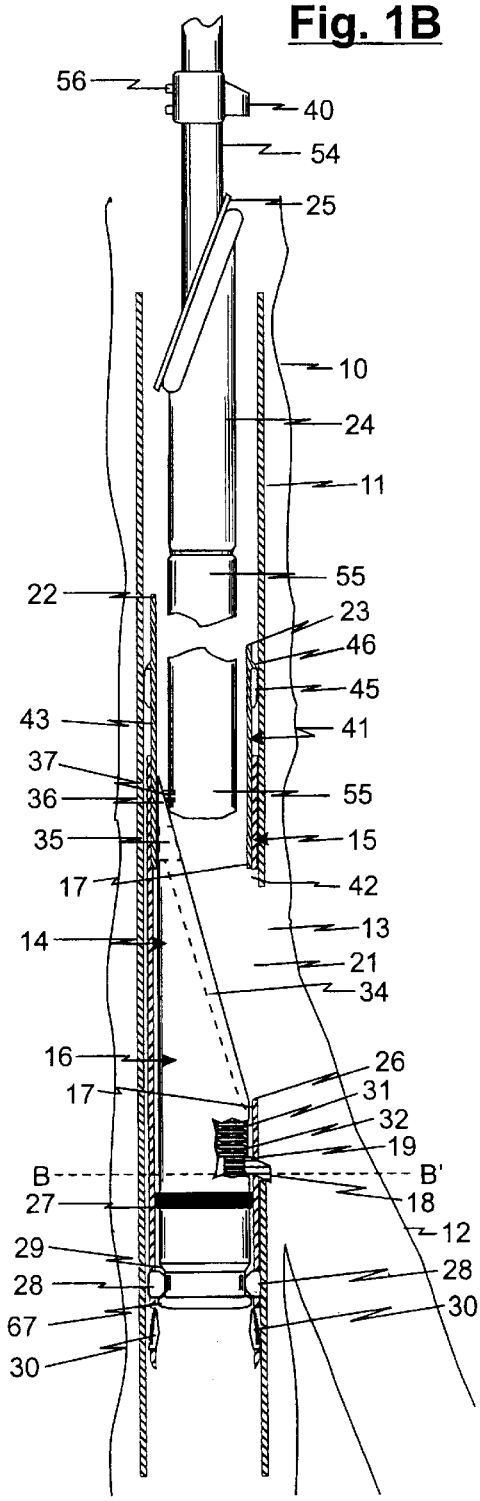
FIG. 1B is side elevation view in partial cross section of the assembly of this invention for forming a seal at the junction of a lateral well bore drilled through a window in the main well bore casing as the assembly has come to rest on the window sill with the key member popped outward into the window opening and coming to rest on the window sill.

In at least the embodiment shown in FIGS. 1A and 1B, the tubular sleeve member 15 is releasablely and functionally connected to a tubular member 24 through intermediated parts but still remains part of the assembly 14. For example the functional connection may be through intermediated parts such as by connecting the tubular member 24 to, for example, a well liner 55 which is connected to the deflection member 16 which is in turn connected to the tubular sleeve member 15 and still be part of the assembly 14 which can then, as in this embodiment, be used to run both the tubular sleeve member 15, deflection member 16, tubular member 24, and the well liner 55 into the main well bore casing 11 and the lateral well bore 12 with only one trip into the well, while setting the intermediate parts and forming a seal. When this embodiment or any other is used the tubular member 24 is part of the assembly 14 and it has a sealing member 25 positioned about the tubular member 24 and an orientation key 40 for orientation of the tubular member 24 and the sealing member 25 relative to the aperture 21 of the tubular sleeve member 15 to bring the sealing member 25 into engagement with the seating surface 17 inside the tubular sleeve member 15 proximate the aperture 21 as the tubular member 24 is run into the lateral well bore 12 and the main well bore casing 11. It will be understood by those skilled in the art that a drill string 53 might be connected to a "Stab-in" 54, which may be a modified drill string section, which is connected to the tubular member 24 and which in turn might be connected to a lateral liner 55 for example or a wire is screen or other tubular material or intermediate material for placement in the lateral well bore 12 and then used to position the tubular sleeve member 15 and deflector member 16 with the window 13 and also run the tubular member 24 with the sealing member 25 positioned about the tubular member 24 into place on one trip into the well. Further those skilled in the art would also understand that a drill string 53 may be used to position the tubular sleeve member 15 and deflector member 16 with the window 13 and then run the tubular member 24 with the sealing member 25 positioned about the tubular member 24 at a later time without departing from the teaching of this invention. However when the tubular member 24 is run with the tubular sleeve member 15 the complete installation of assembly 14 can be completed for achieving a seal at the junction of a lateral well bore 12 and a main well bore casing 11 in a single trip into the well, which as those skilled in the art will appreciate is desirable.

By referring to FIGS. 2A through 2F it can be better understood how key 18 is used with the window 13 and sill 20 of the window 13 to align and position the tubular sleeve member 15 with it's aperture 21 in position with the window 13. As those skilled in the art will appreciate there are many kinds of windows which can be used by the industry in the multilateral or lateral drilling process and the assembly 14 of this invention can be used with almost all of them to practice the teaching of this invention for forming a seal at the junction of the lateral well bore 12 with the main well bore casing 11. Thus this assembly 14 and the method of it's practice have universal application in the lateral and multilateral well arts with all types of windows.

Figure 2A:
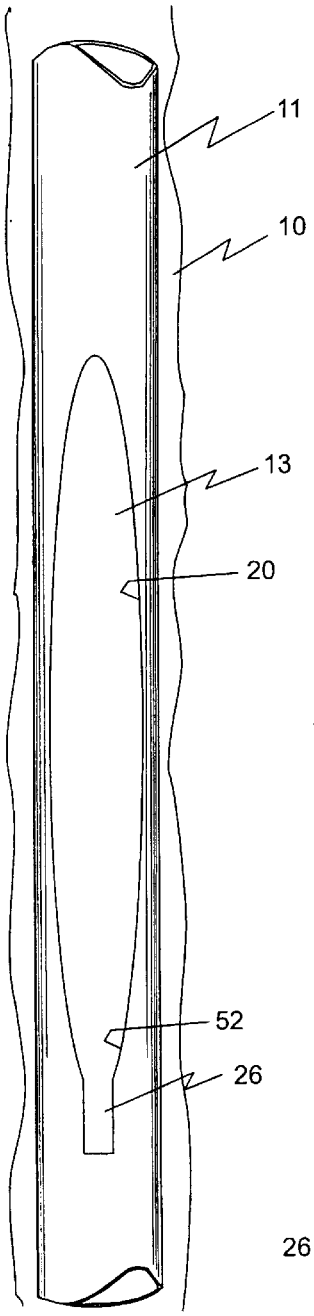
FIG. 2A is a front elevation view of main well bore casing having a window there in and through which a lateral well bore would have been drilled and in this embodiment an orientation key way is provided at the down hole end of the window sill for receiving a key member but as shown here no key member has reached the window and all that is showing is the window section in the well bore.

For example referring to FIG. 2A a window 13 is shown formed in the main well bore casing 11 with a window key way 26 provided at the down hole end or sill 52 of the window 13 and located in the main well bore 10. As shown in this FIG. 2A view the assembly 14 has not yet arrived at the window 13 because the window is clear. However by referring to the representational FIG. 2E it can be seen the assembly 14 of this invention has arrived at the window 13 and the key 18 which is connected to the assembly 14 has popped outwardly into the window 13 and is being lowered by the operator down hole. It can be seen in FIG. 2D that the sill 20 of the window 13 is guiding the key 18 and the assembly 14 into correct orientation and position as the whole assembly 14 is being lowered down hole by the operator from above. The key 18 will be in position when it reaches the down hole sill 52 at the down hole end of the window 13.

Figure 2B:
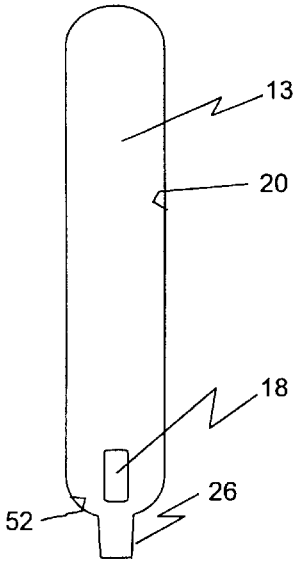
FIG. 2B is a representational front elevation view of a main well bore casing having a pre-cut window there through and showing a pre-cut key way in the window and the key member has popped outward into the window and is moving downward with rest of the assembly (not shown here) to find the key way for orientation of the rest of the assembly of this invention.
Figure 2C:
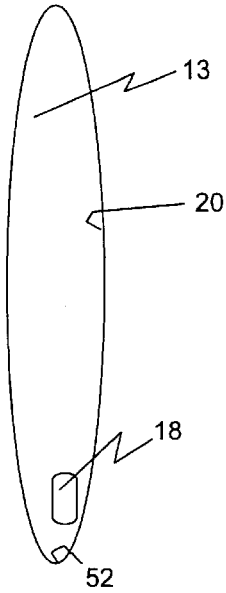
FIG. 2C is a representational front elevation view of a main well bore casing which is the natural result of down hole milling the window in the casing while down hole and the key member has popped outward into the window and is moving downward with the rest of the assembly (not shown) to land on the window sill of the window for orientation of the assembly.
Figure 2D:
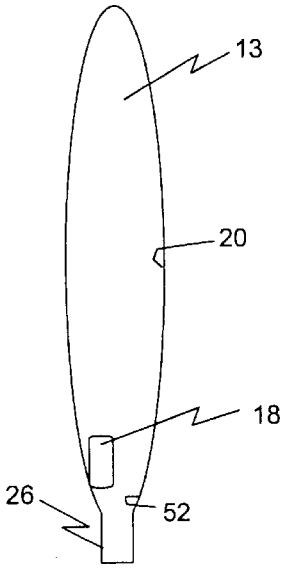
FIG. 2D is a representational front elevation view of a main well bore casing which has a down hole milled key way milled in the window of the casing and the key member is being guided by the window sill to orient the assembly (not shown) of this invention and bring the key member to rest in the down hole milled key way.
Figure 2E:
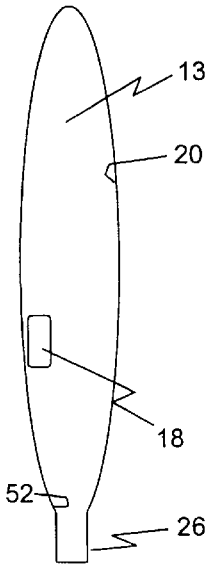
FIG. 2E is a representational front elevation view of a main well bore casing which has a down hole milled key way milled in the window of the casing and the key member is being actively guided by the window sill to orient the assembly (not shown) of this invention in the process of bring the key member to rest in the down hole milled key way.
Figure 2F:
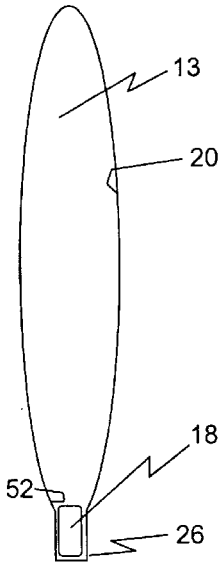
FIG. 2F is a representational front elevation view of a main well bore casing which has a down hole milled key way milled in the window of the casing and the key member has been guided by the window sill to orient the assembly (not shown ) of this invention and the key member is at rest and secured in the down hole milled key way.

Referring to FIG. 2F, it can be seen that the key 18 has finally come to rest in the key way 26, when the window 13 has a key way 26, which will positively position and align the aperture 21 of the tubular sleeve member 15 and the deflector member 16 with the window 13 of the main well bore casing 11 for the practice of this invention in forming a seal at the junction of the lateral well bore 12 in the main well bore casing 11.

Referring to FIG. 2B as a further example, it can be seen that in a pre-cut window 13, which would have been added to the main well bore casing 11 as part of making up the main well bore casing 11, provides a window 13 and sill 20 with a key way 26 at the down hole sill 52 also for the practice of this invention using the assembly 14. In FIG. 2B however as shown, the key 18 is not quiet in position in the key way 26 and thus the positioning and alignment of the assembly 14 has not been achieved yet, but is in process.

Referring to FIG. 2C, by way of explanation, it can be seen that a window 13 and sill 20 have been formed by a down hole milling operation and the window 13 and the sill 20 which are formed are just the natural result of the target configuration produced by the milling bit which would have been used to mill them in the down hole milling process. This natural result however allows the use of the assembly 14 of this invention to form a seal at the junction of the lateral well bore 12 and the main well bore casing 11 in the same manner as with the premilled windows 13.

In some down hole milled window art, the art has perfected ways to also mill key ways down hole to achieve better alignment and positioning of tools for multilateral operations. For example in FIG. 2D, it can be seen that in a down hole milled window 13 and down hole milled key way 26 the assembly 14 of this invention is still useful. In the FIG. 2D shown, the key 18 has popped outwardly into the window 13 and has engaged the sill 20 of this window 13 which will give the operator on the surface an indication that the assembly 14 has reached the window 13. The operator then would just let down on the drill sting, on which this assembly 14 might be run, to allow the sill 20 of the window 13 to guide the key 18 into the key way 26 for bring the assembly 14 of this invention into alignment with the window 13. Once again the assembly 14 of this invention can be used with yet another type of window 13 and key way 26 found in the industry to achieve the results of this invention.

By now referring to FIG. 1A and FIG. 1B it will be seen that in FIG. 1A that the assembly 14 with the key 18 popped outwardly through the key hole 19 into the window 13 has, thus, found the window 13 and is being lowered down hole toward the key way 26 but has not yet come to rest in the key way 26, and is at a position A—A as shown, while in FIG. 1B the key 18 has come to rest in the key way 26, and is at a position B—B as shown. In this embodiment the tubular member 24 is being used in conjunction with a drill string 53, not shown in these figures, and a "Stab In" 54 connected at a drill collar 62, not shown in these figures, to run the tubular sleeve member 15 into the main well bore casing 11 and into alignment with the window 13. However the tubular member 24 and tubular sleeve member 15 may be run on any running device capable of running tools into the main well bore casing 11. It should be noted that in other embodiments that the tubular sleeve member 15 may be set first and then the tubular member 24 might be run into the main well bore casing 11 and lateral well bore 12 at a later time without departing from this invention.

Figure 3A:
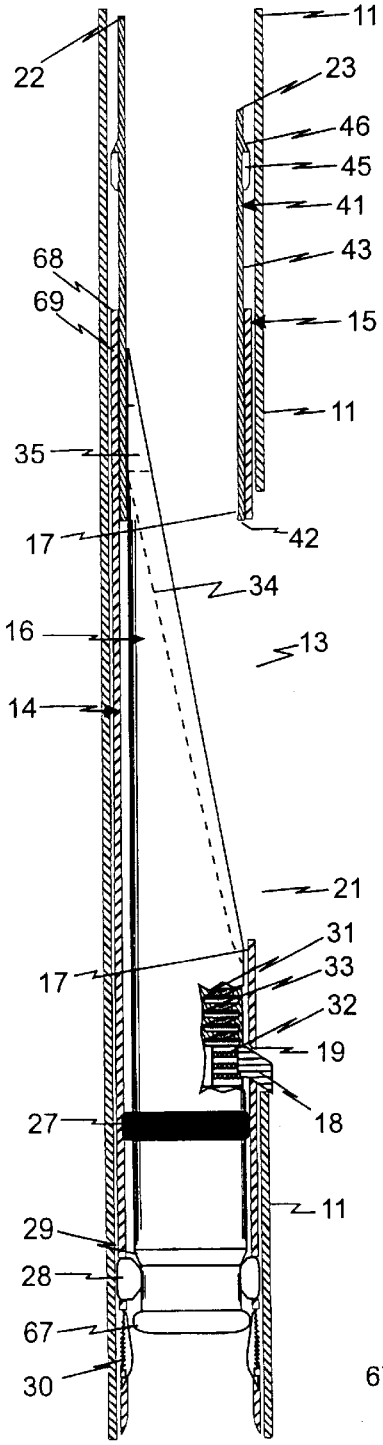
FIG. 3A is a side elevation view in partial cross section of the key member as it is mounted in the deflector member and showing the key member just as the tubular sleeve member having an aperture through one side is aligned with the window in the well bore casing.
Figure 3B:
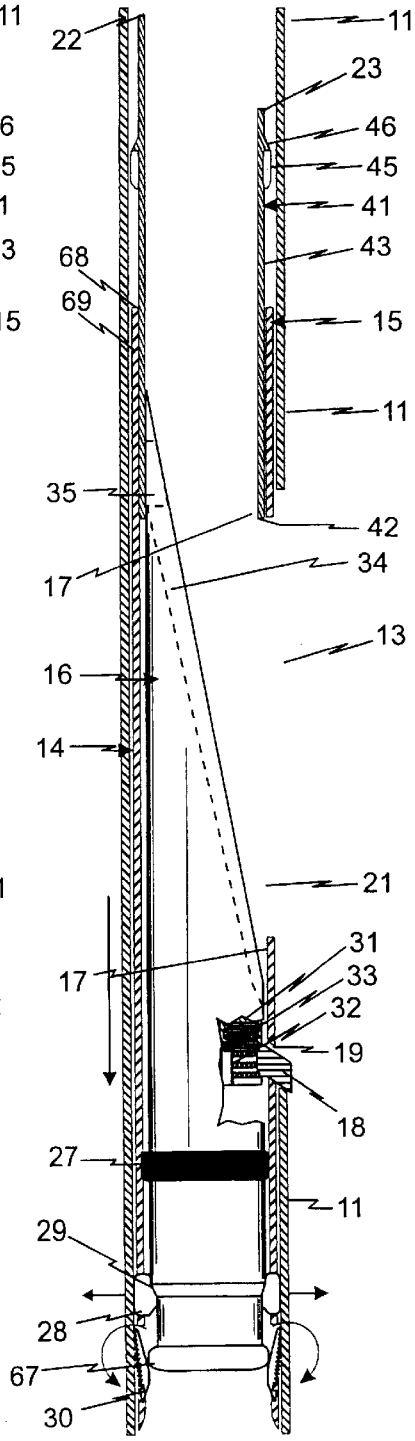
FIG. 3B is a side elevation view in partial cross section of the key member as it is mounted in the deflector member and showing the key member with additional pressure having been applied to the deflector member to overcome the spring in the key member for driving the deflector member downward while the key member is stopped in the key way, and thereby forces the setting of the seal member and slip grabbing members to secure the tubular sleeve member and deflector member in a sealed and fixed position in the main well bore casing.

Referring to FIG. 1A, which is the running position of the assembly 14, it can be seen, in this embodiment, that the deflector member 16 is positioned in the tubular sleeve member 15 and releasable and slidably sealed therein by an o-ring seal 27 which thus seals the tubular sleeve member 15 from fluid flow there through once the tubular sleeve member 15 is set in the main well bore casing 11. Also, as best seen in FIGS. 3A and 3B, packer seal 28 is mounted on and through the tubular sleeve member 15 for being driven outwardly to form a seal between the main well bore casing 11 and the tubular sleeve member 15. Further mounted down hole on tubular sleeve member 15 are slip grabbing members 30, which are mounted for being driven outwardly into the main well bore casing 11 to grip the main well bore casing 11 for setting the tubular sleeve member 15 to prevent the movement of the tubular sleeve member 15. It should be understood by referring to the FIGS. 3A & 3B that once the key 18 comes to rest in the key way 26, then because the key 18 is passed through the key hole 19 of the tubular sleeve member 15, the tubular sleeve member 15 comes to a stop. Also coming to a stop are the parts mounted therein, such as the packer seal 28, slip grabbing members 30, and key 18. When the tubular sleeve member 15 come to a stop in the main well bore casing 11, the aperture 21 is aligned with the window 13. The deflector member 16, however, while being releasable and slidably sealed in the tubualr sleeve member 15 would continue downward in response to the well operator continuing to let the drill string 53 down hole.

The key 18 is mounted into the deflector member 16 in a spring receiving box 31, which has a first key spring 32 therein for compression by the key 18 when the assembly 14 is being run into the main well bore casing 11 but which is outwardly biased against the key 18 for popping the key 18 through the key hole 19 into the window 13 as has already been discussed. However, also mounted in the spring receiving box 29 is a second key spring 33 for keeping the key 18 in a downward position until the key 18 comes to a stop when the key 18 comes to rest on the downhole sill 52 or key way 26 of the window 13, but will then compress and allow the deflector member 16 to continue downward motion while the key 18 remains in the stopped position. As the key 18 previously discussed is stopped the tubular sleeve member 15 with the packer seal 28, and the slip grabbing members 30 are also stopped, but the releasable and slidable sealed deflector member 16 continues downward and drives against the packer seal 28 with a 1st cam surface 29 located proximate the packer seal 28 to press the packer seal 28 into sealing engagement with the main well bore casing 11. Also on the down hole end of deflectoin member 16 is a 2nd cam surface 67 which is located proximate the slip grabbing members 30 for driving the slip grabbing members 30 outwardly into the main well bore casing 11 to grip the main well bore casing 11 for setting the tubular sleeve member 15 to prevent the movement of the tubular sleeve member 15 This configuration at least in this one embodiment, thus allows for the sealing and fixedly setting of the tubular sleeve member 15 in the main well bore casing 11 with the aperture 21 of the tubular sleeve member 15 and the window 13 aligned for further operations which will be discussed.

Figure 4:
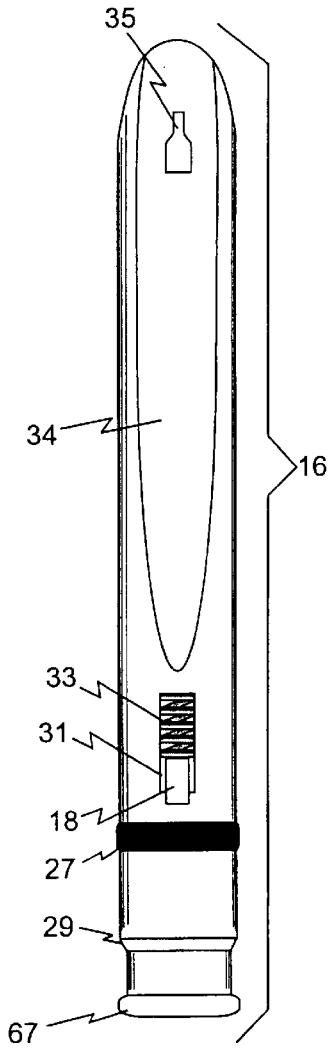
FIG. 4 Is a front elevation of the deflector member of this invention out of the tubular sleeve member of the assembly of this invention.
Figure 5A:
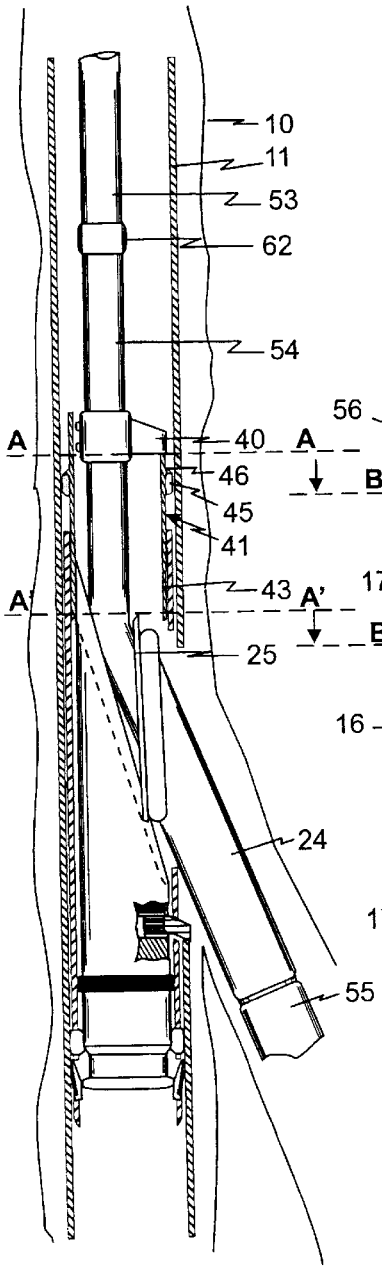
FIG. 5A is a side elevation view of the assembly of this invention in partial cross section which shows the deflector member positioned and releasable seated in the tubular sleeve member and the deflection member and key member having set the seal member to form a seal down hole in the main well bore casing between the main well bore and the tubular sleeve member and having set the slip grabbing means to prevent movement of the tubular sleeve member and the tubular member has been functionally separated from the deflector member and deflected and landed into the lateral well bore. Further the orientation key member is at position A—A in the muleshoe key way and the lower part of the aperture is at A'—A' but prior to any controllable collapsing of the upper part of the tubular sleeve member in communication with the aperture.
Figure 5B:
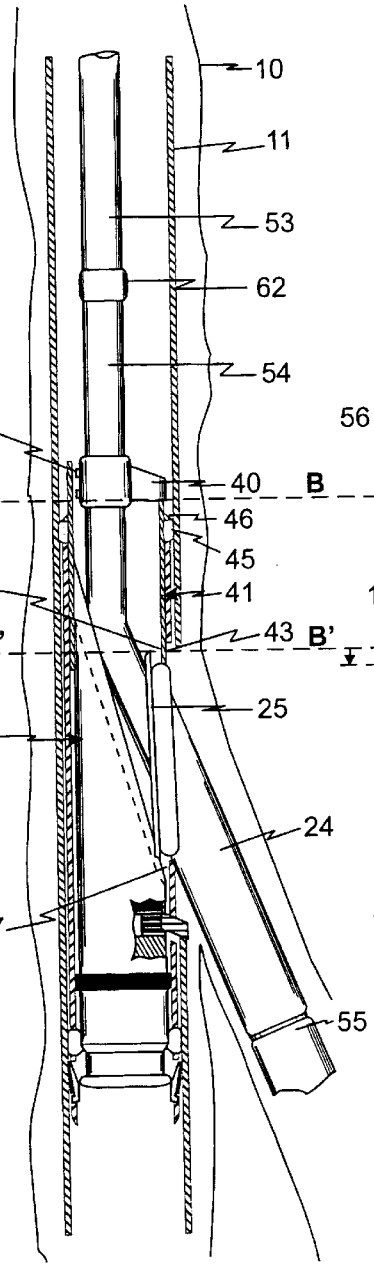
FIG. 5B is a side elevation view of the assembly of this invention in partial cross section which shows the orientation key member for orientation of the tubular member seated in the key way of the mule shoe and the tubular sleeve member having been driven downward to set the up hole seal between the main well bore casing and the tubular sleeve member and having moved to a stopped position. Further the orientation key member is now shown at position B—B in the muleshoe keyway and has controllably collapsed the upper part of the tubular sleeve member in communication with the aperture and has moved the lower part of upper part of the tubular sleeve member in communication with the aperture to B'—B' and the sealing member positioned about the tubular member for seating with the seating surface inside the tubular sleeve member proximate the aperture is being moved into place.
Figure 5C:
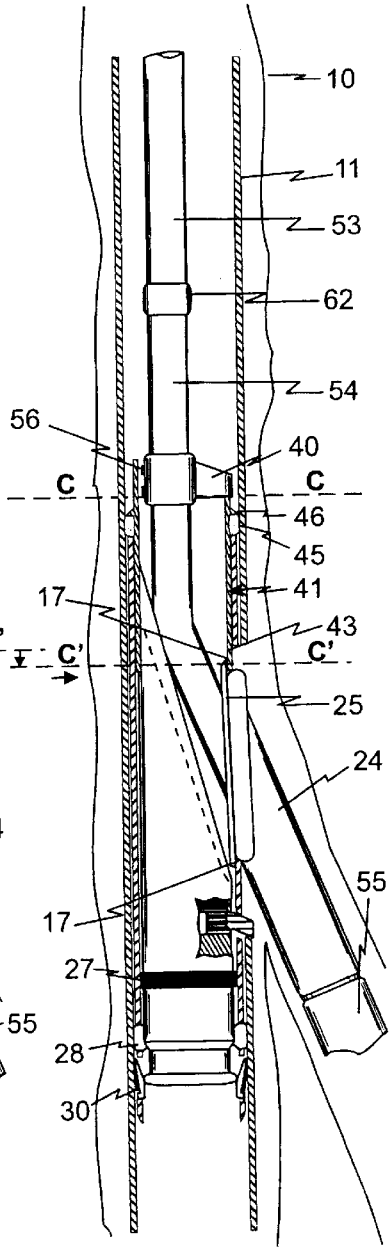
FIG. 5C is a side elevation view of the assembly of this invention in partial cross section which shows the orientation key member for orientation of the tubular member and the key member seated in the key way of the mule shoe with the tubular sleeve member driven downward to a stopped position C—C and the tubular member released from the orientation key member to move further downward to finally seat the sealing member against the seating surface inside the tubular sleeve member proximate the aperture through the tubular sleeve member at C'C'.

It should be noted that the deflector member 16 has an inclined upper surface 34 for deflecting the tubular member 24 or any other tubular good, such as liner 55, through the window 13 when the tubular member 24 is run into contact with the inclined upper surface 34 of the deflection member 16. Also located on the up hole end of the deflector member 16, as best seen in FIG. 4, is provided a female retrieving member 35 which will be more fully explained later but is for the purpose of pulling the deflection member 16 out of the tubular sleeve member 15 after the seal has been formed in the lateral well bore 12 and the main well bore casing 11.

Further in some embodiments of the deflector member 16, attachment points 36 are provided along this inclined upper surface 34.

Also in some embodiments where the assembly 14 of this invention is to be run as a unitized assembly, the deflector member 16 has attaching points 36 which are provided on the deflector member 16 for allowing the attachment of a controlled releasable connector member 37, as for example shear pins, for joining the deflector member 16 releasablely and functionally to the tubular member 24 whether directly or functionally, for example through a lateral liner 55 for running the assembly 14 into the main well bore casing 11. In this configuration the controlled releasable connector member 37 allows the controlled release of the controlled releasable connector member is 37 after the deflector member 16 is stopped from down ward motion. The deflector member 16 is stopped when it has moved down hole the distance allowed by the second key spring 33 and spring receiving box 31. Once the deflector member 16 can no longer be moved down hole, then the controlled releasable connector member 37 are released at the attaching point 36 such that the tubular member 24 and the lateral liner 55, for example, may continue down ward motion. Thus the tubular member 24 with the sealing member 25 position about the tubular member 24 can continue to be lowered down hole for the formation of a seal at the junction of the lateral well bore 12 and the main well bore casing 11 at the window 13, after the tubular sleeve member 15 and deflector member 16 are fully set in place in the main well bore casing 11. It should also be understood that the tubular sleeve member 15 could be set first and then the tubular member 24 could be run at a later time without departing from the teachings of this invention. Also between the attaching point 36 and the tubular member 24 may be connected other tubular goods, which would be intermediate thereto, for insertion into the lateral well bore 12 and which also provide a functional connection of the tubular member 24 and the deflector 16.

As the Tubular member 24 with the sealing member 25 positioned thereabout, continues down ward motion, an orientation key 40 releasablely connected to the stab in 54 by shear pins 56 at a predetermined distance from the sealing member 25 comes into engagement with the tubular mule shoe 22, located on the up hole end of the tubular sleeve member 15 and provides mechanical guidance of the orientation key 40 to the mule shoe key way 23 for orientation of tubular member 24 and the sealing member 25 positioned thereabout. Once the orientation key 40 is stopped in the mule shoe key way 23 in the proper orientation, continued down hole pressure is applied to the tubular member 24 and the orientation key 40 shears shear pins 56 and releases the stab in 54 and tubular member 24 for a final push to put the sealing member 25 into place against the seating surface 17 inside the tubular sleeve member 15 proximate the aperture 21 and puts the tubular member 24 and the stab in 54 into the lateral well bore 12. It would be understood by those skilled in the art that a lateral liner, lateral screen, or any other tubular goods could be used in place of the stab in 54 or with the stab in 54 to put them into the lateral well bore 12 in this manner and still form the seal of this invention.

In yet other embodiments of the assembly 14, the tubular sleeve member 15 is formed in two pieces with the upper part, generally referred to at 41, of the tubular sleeve member 15 being for controlled collapse and for sealing the tubular sleeve member 15 against the main well bore casing 11 proximate the upper part 41 of the tubular sleeve member 15 and for downward adjustment of the upper part, generally referred to at 42, of the aperture 21 in the tubular sleeve member 15 by bringing the seating surface 17 located on the upper part 42 of the aperture 21 inside the tubular sleeve member 15 proximate the aperture 21 into a preferred configuration for mating with the sealing member 25 positioned about the tubular member 24 for seating.

Yet in other embodiments of the assembly 14 the tubular sleeve member 15, as set out above, may be formed in two pieces which are respectively the upper part 41 and lower part 69. The upper part 41 of the tubular member 15 being formed into a tubular insert 43 for insertion into the lower part 69 of the tubular member 15 as shown in FIGS. 6, 7A, and 7B. Further the tubular insert 43 has an arched lower section 44 which frames the upper part 42 of the aperture 21 of the tubular sleeve member 15, as shown in FIGS. 6, 7A & 7B. Also connected to the tubular insert 43 is a circular packer seal 45 with a fixed compression ring 46 positioned above the circular packer seal 45 for compressing the circular packer seal 45 into sealing engagement with the main well bore casing 11 for forming a seal there between when the tubular insert 43 is moved downward and the circular packer seal 45 is compressed against the up hole end 68 of the lower part 69 of the tubular sleeve member 15. In this embodiment once the orientation key 40 is stopped in the mule shoe key way 23 in the proper orientation, continued down hole pressure is applied to the tubular member 24 and the orientation key 40 drives the upper part 41 of the tubular sleeve 15 or in this embodiment tubular insert 43 downward, which also moves the arched lower section 44, which is formed in the tubular insert 43, downward with the resulting change in the configuration of the aperture 21, as best seen in FIGS. 6, 7A & 7B.

Figure 8:
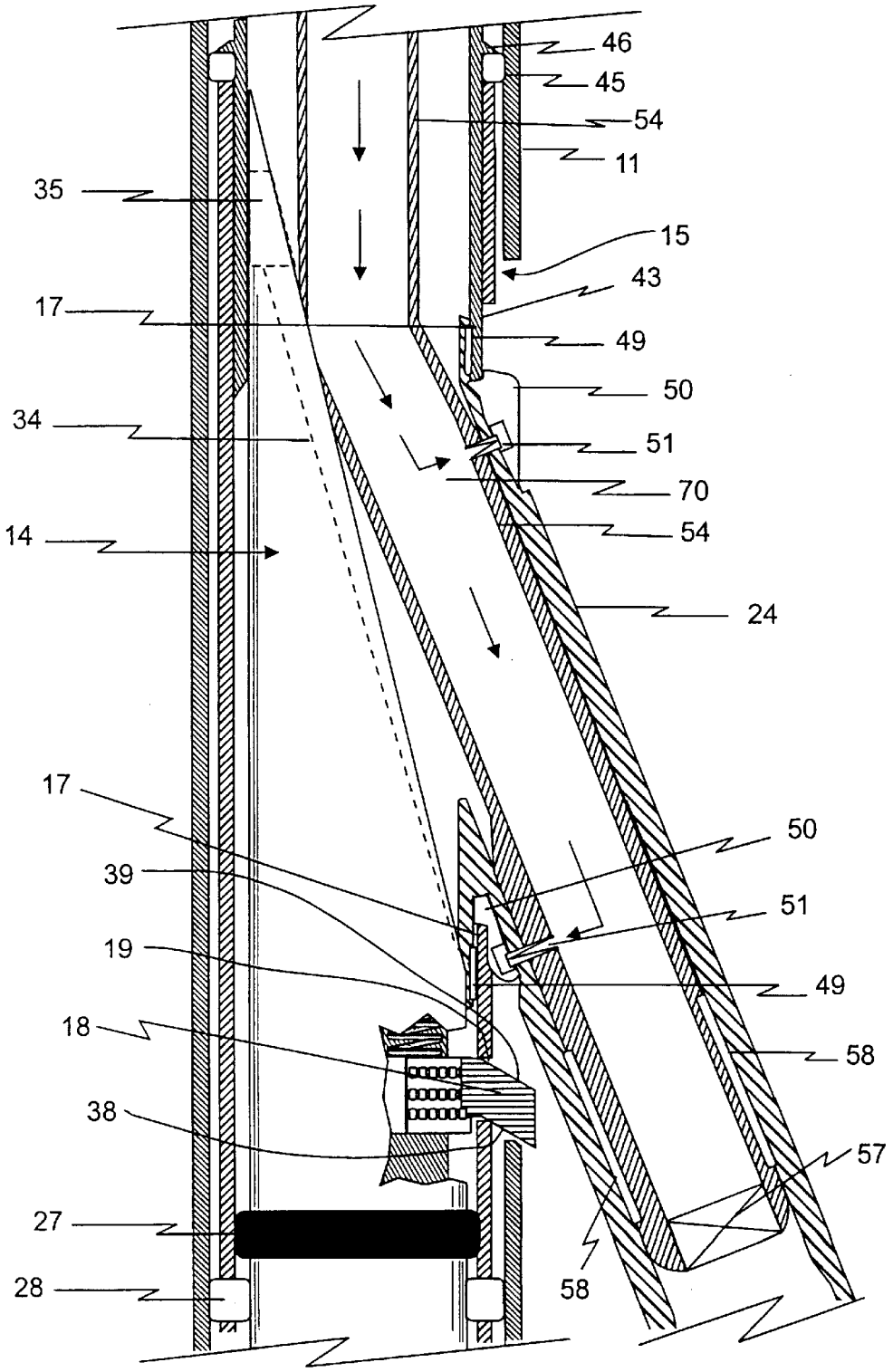
FIG. 8 is a partial cross section of the tubular sleeve member, the tubular member, the sealing means positioned about the tubular member and seated with the surface inside the tubular sleeve member proximate the aperture and showing an elastic tubular seal member and a one way check valve to inflate the elastic tubular seal member.

In this embodiment the outside surface of the tubular insert 43 has sealing and gripping surfaces 47 for mating with sealing and gripping surfaces 48 located on the inside of the tubular sleeve member 15 when the two sealing and gripping surfaces 47 & 48 are pushed together. Thus when the orientation key 40 drives downward on the mule shoe key way 23 it drives the tubular insert 43 with the sealing and gripping surfaces 47 into engagement with the sealing and gripping surfaces 48 to both seal the tubular insert 43 and the inside surface of the tubular sleeve member 15. Once the sealing and gripping has occurred continued pressure on the tubular member 24 releases the tubular member 24 and stab in 54 from the orientation key 40 by shearing shear pins 56 for the final push to put the sealing member 25 into place against the seating surface 17 inside the tubular sleeve member 15 proximate the aperture 21 which has now had the configuration of the aperture 21 changed by the arched lower section 44 of the tubular insert 43 being moved down ward and the sealing gripping surfaces 47 ad 48 are mated. One of the functions for the adjustment of the configuration of the aperture 21 is to provide both a sealing engagement between the sealing member 25 positioned about the tubular member 24 and the seating surface 17 inside of the tubular sleeve member 15 proximate the aperture 21 and also between the tubular member 24 and the aperture 21 by the downward movement by the arched lower section 44 thus forming a seal at the junction of the lateral well bore 12 and the main well bore casing 11, as shown in FIG. 8. Even in some embodiments as shown in FIGS. 7A & 7B, compressible material 61 is connected about the aperture 21 of the tubular sleeve member 15 for sealing the tubular member 24 when the aperture 21 is downwardly adjusted by the arched section 44.

In yet other embodiments as shown in FIG. 8 the sealing member 25 has positioned thereon a compression seal gasket 49 for forming a compression seal when the sealing member 25 is brought into engagement with the seating surface 17 inside the tubular sleeve member 15 proximate the aperture 21 as the tubular member 24 is run into the main well bore casing 11.

Figure 9:
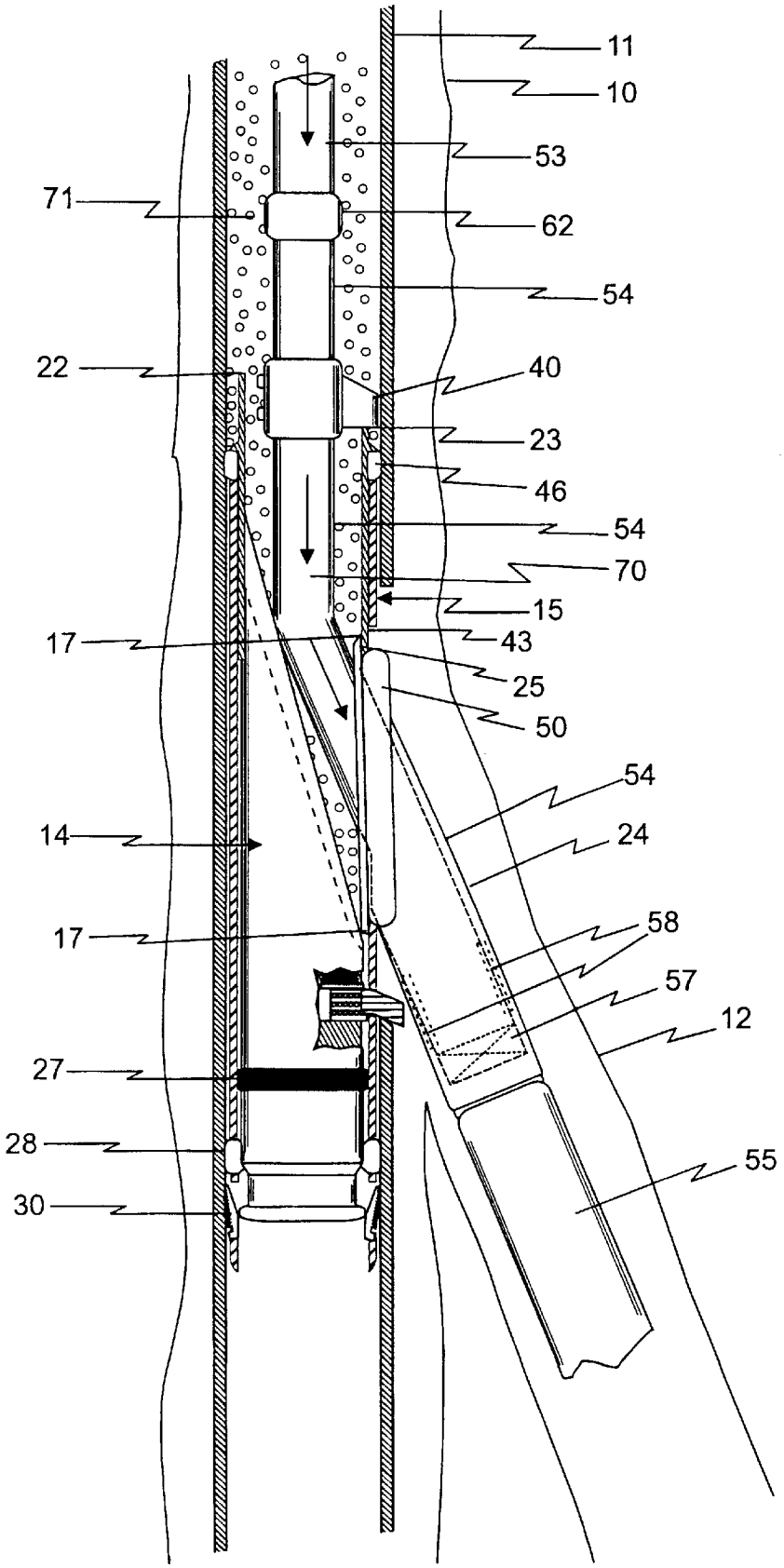
FIG. 9 is a partial cross section of the seal at the junction formed in a lateral well bore and the assembly of this invention being used to pressure check the seal before leaving the well and pulling the equipment from the well.

Another embodiment, as also show in FIGS. 8 and 9, shows a elastic tubular seal 50 about the sealing member 25 of the tubular member 24 which is in fluid communication by way of a one way check valve 51, as best seen in FIG. 8, for receiving fluid 70 from the drill string 53 to expand the elastic tubular seal 50. By expanding the elastic tubular seal 50 as the fluid 70 is received through the tubular member 24 and drill string 53, the elastic tubular seal 50 expands against the tubular sleeve member 15 which forms the aperture 21 and against the tubular sleeve member 15 outside and proximate the aperture 21 for providing a seal which will prevent well fluid 63 movement either into or out of the aperture 21 and for holding the tubular member 24 and the tubular sleeve member 15 together against movement. Once the initial sealing as described above has been done then a pressure check of the seal formed between the lateral well bore 12 and the main well bore casing 11 can be conducted while all the equipment of the assembly 14 is in place in the well, as shown in FIG. 9. This test is done by pressuring up the well fluids 63 or any other desired fluids in the well and checking for leaks. If the seal formed is not as desired, then additional fluid 70 may be pumped in to expand the elastic tubular seal 50 further until a desired seal is formed, as shown by FIGS. 8 & 9. As those skilled in the art would appreciate the stab in 54 would have a cap 57 to allow the fluid 70 to have a pressure build up to perform this operation. Also those skilled in the art will appreciate the benefits of being able to test the seal before removing all the equipment of the assembly 14 used to form the seal and not have to reset up and run the sealing operation again, if it is not successful. Once the desired sealing is formed, as those skilled in the art will appreciate the fluid 70 which was pumped into the elastic tubular seal 50 will set up and become solid, like a cement, for forming a very rigid seal. Also as seen in FIG. 8, the stab in 54 is sealed in place by a well bore seal 58 located in the tubular member 24, which holds until it is desired to pull the stab in 54 out of the tubular member 24. Also as those skilled in the art will know the stab in 54 may be hydraulically disconnected form the tubular member 24 when it is desired to pull them from the main well bore casing 11.

Figure 11:
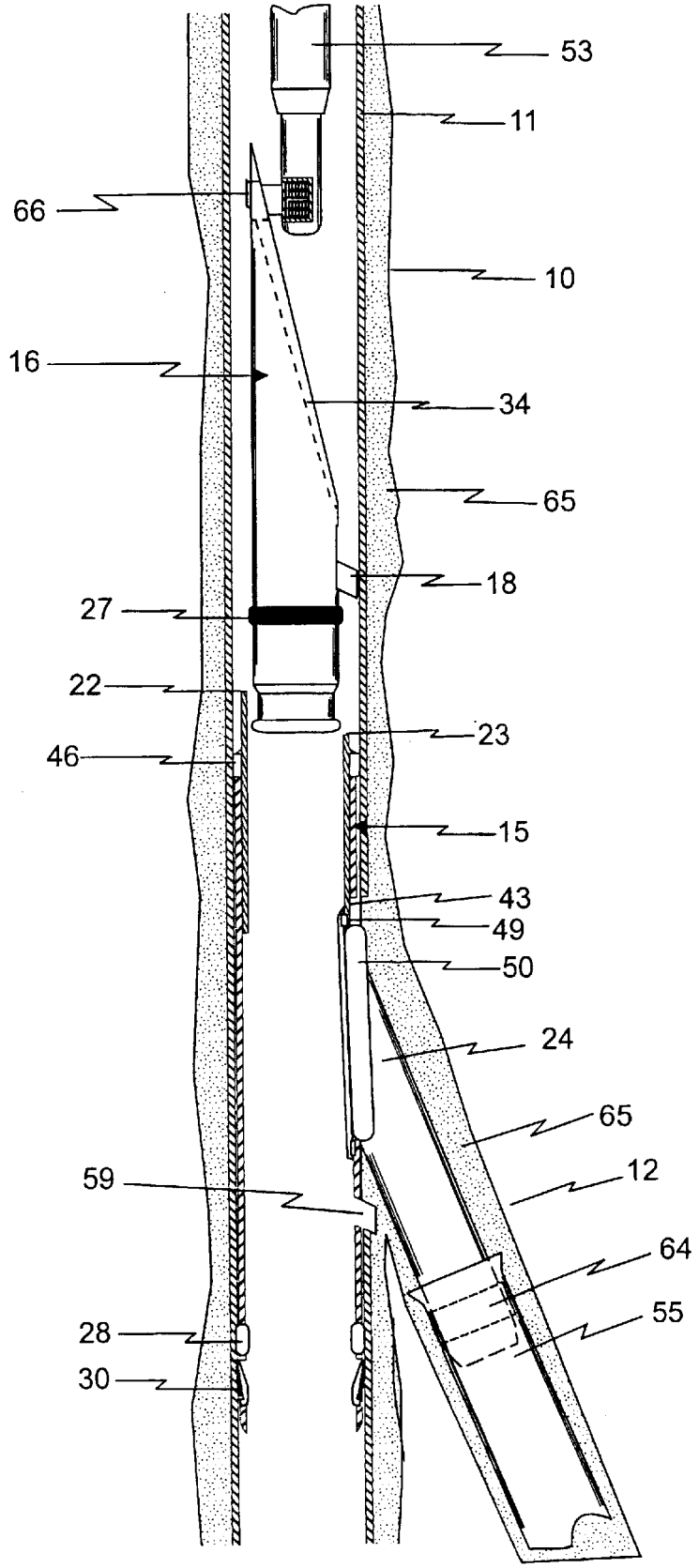
FIG. 11 is a partial cross section of the deflector member being pulled from the tubular sleeve member after the seal at the junction of the lateral well bore drilled through the window in the main well bore casing has been formed and showing that the main well bore casing will be substantially clear after the seal at the junction was formed.
Figure 12:
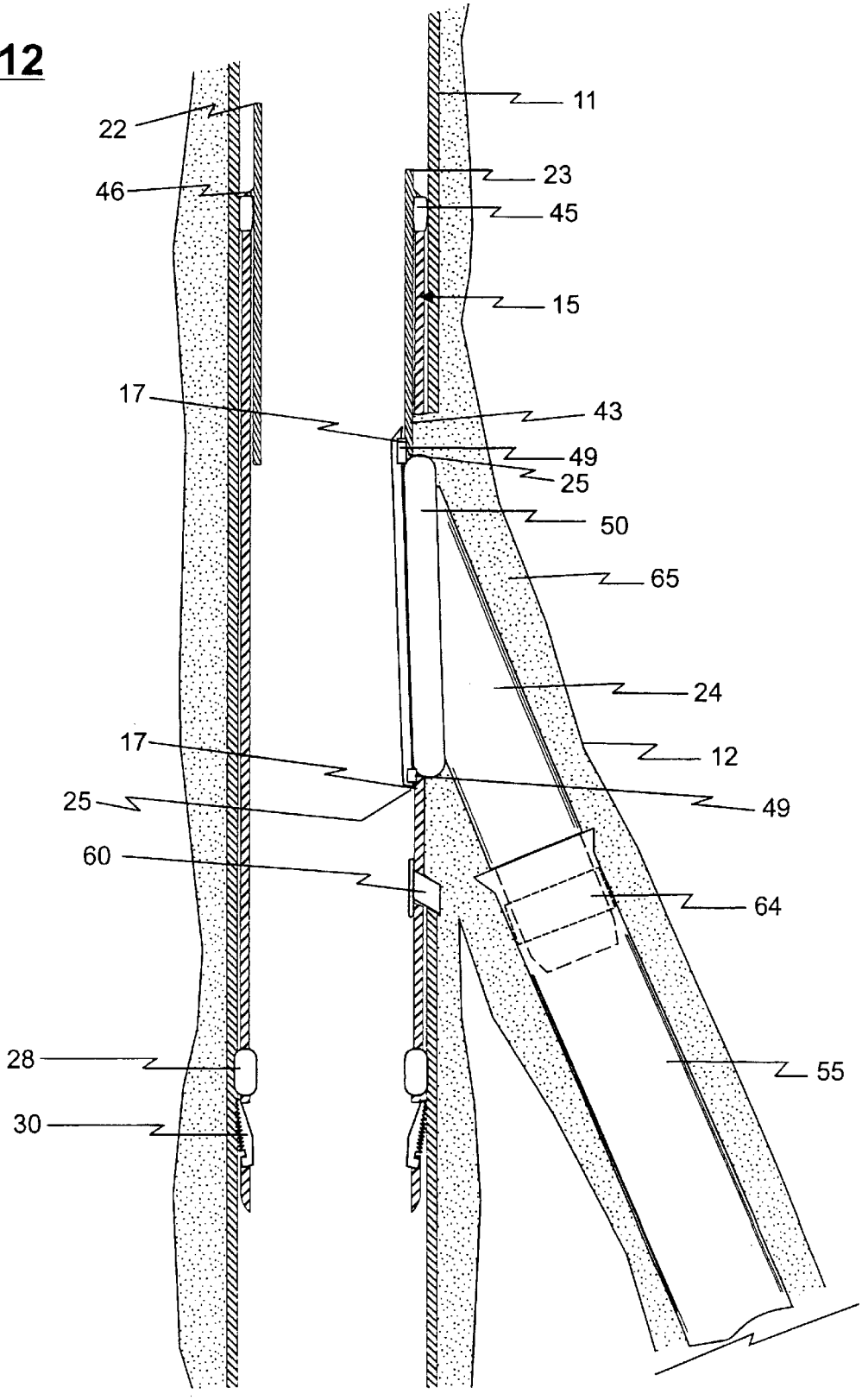
FIG. 12 is a partial cross section of the main well bore casing with the seal at the junction of the lateral well bore drilled through the window in the main well bore casing has been formed and showing that the main well bore casing is substantially clear after the seal at the junction was formed.

Once the seal between the lateral well bore 12 and the main well bore casing 11 is completed the deflection member 16 may be retrieved from the well as shown in FIG. 11 by running a drill string 53 with a male retrieving member 52 to engage with the female retrieving member 35 on the deflection member 16 and then pull the deflection member 16 from inside the tubular sleeve member 15 and clear of the window 13. Once the deflection member 16 is removed from the main well bore casing 11 as shown in FIG. 13 the main well bore casing 11 is substantially clear and open for further well operations below the junction of the seal between the main well bore casing 11 and the lateral well bore 12. In some cases it will be desired to seal the key cavity 59, as shown in FIG. 11, which the key 18 would leave in the cement 65, more securely than with just cement 65, once the deflection member 16 and key 18 are removed. In such cases an impervious plug 60, as shown in FIG. 12, would be set and sealed in the key cavity 59 using the mule shoe 22 and the mule shoe key way 23 with a running tool to locate and position the impervious plug 60 in the hole and seal it. The ability to set this impervious plug 60 in the key cavity 59 points out one of the benefits of the use of the assembly 14 of this invention not only for setting the impervious plug 60, but also for reentry back into the lateral well bore at any later time. This is achieved by the mule shoe 22 and mule shoe key way 23 remaining in the main well bore casing 11 to give a point which can easily and specifically be located, for example, the key cavity 59. By knowing the exact distance the key cavity 59 is from the mule shoe key way 23 on the tubular sleeve member 15 it can be easily found from the surface of the main well bore casing 11 and the impervious plug 60 put in place. Those skilled in the art will realize that this is a useful feature of this invention and will also realize that the overall inside diameter of the main well bore casing 11 with the tubular sleeve member 15 left behind in the main well bore casing 11 would not greatly reduce the inside diameter and thus allow other well operations to be conducted further down the main well bore casing 15.

Figure 10:
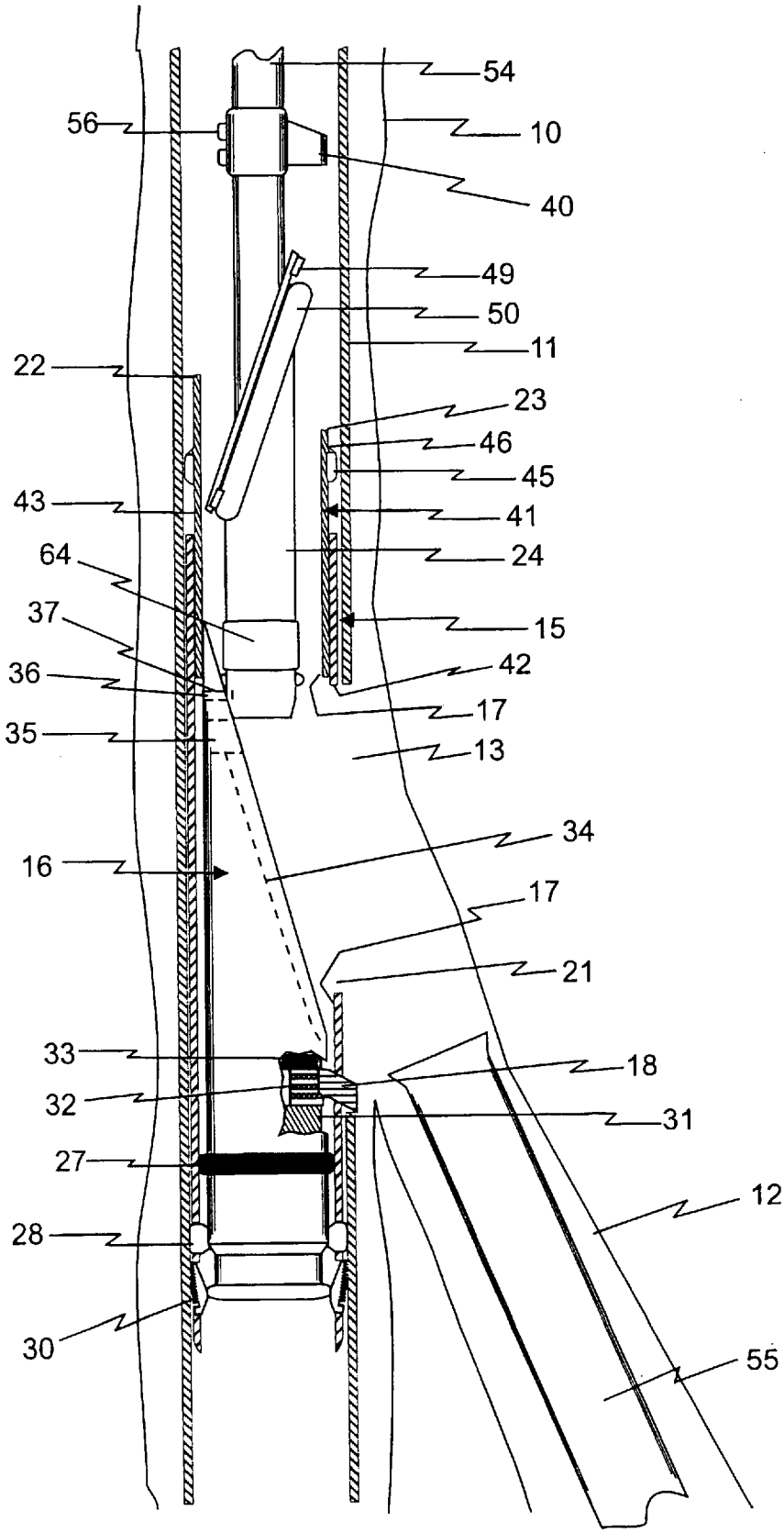
FIG. 10 is a partial cross section the tubular sleeve member and deflector member in place in the well and the tubular member and sealing member positioned about the tubular member for seating being run on a different trip into the well to form a seal a the junction of the lateral well bore drilled through the window in the main well bore casing.

In certain applications the assembly 14 may be run in two separate runs, such that the deflection member 16 and tubular sleeve member 15 may be run into the main well bore casing 11 and used as a standard "Whip Stock" for setting lateral well bore liner 54, or lateral well bore screens, etc. and then the tubular member 24 with the sealing member 25 positioned about the tubular member 24 may be run into the well on a later run to form the seal using a tubular member 24, with a "Stab In" 54 to join the lateral well bore 12 and the main well bore casing 11 as shown in FIG. 10 without departing from the teachings of this invention.

It should be noted that the key 18 at least in some embodiments, as shown in FIG. 8, has a downwardly sloping front face 38 for grabbing on to the sill 20 of the window 13 and pulling the tubular sleeve member 15 in to very positive engagement against movement down hole. Further it should be noted that key 18 at least in this embodiment may also have downward sloping back face 39 for acting as a cam surface to drive the key 18 back into the spring receiving box 31 upon the deflector member 16 being removed from the tubular sleeve member 15 after completion of the seal operations.

It will be appreciated by those skilled in the art that the tubular sleeve member 15 is sized to fit into the main well bore casing 11 or other tubular member into which it may be used and is sized to receive the deflection member 16 and have the O-ring seal 27 of the deflection member 16 to seal the tubular sleeve members 15 from fluid flow through the inside diameter of the tubular sleeve member 15. As those skilled in the art will appreciate the optimum would be for the inside diameter of the tubular sleeve 15 to be as large as possible and yet still receive the benefits of this invention because the larger the inside diameter of the tubular sleeve 15 the less the main well bore casing clearance would be reduced after the seal at the junction of the lateral well bore 12 and the main well bore casing 11 is completed and the deflection member 16 is removed.

The method of using the assembly 14 of this invention for forming a seal at the junction of a lateral well bore 12 drilled through a window 13 in at least a main well bore casing 12 comprising in one embodiment the steps of running a tubular member 24 with a sealing member 25 positioned about the tubular member 24 into the main well bore casing 11 which is functionally and releasably connected to a deflector member 16 which is positioned in the tubular sleeve member 15 having an aperture 21 through at least one side of the tubular sleeve member 15, and releasable sealed in the tubular sleeve member 15 and having an orientation key 18 positioned thereon. Then as the tubular sleeve member 15 is gently rotated while being lowered into the main well bore casing 11, popping outwardly open the orientation key 18 for orientation of the deflection member 16 in the window 13 which is in the main well bore casing 11 when the orientation key 18 reaches the opening of the widow 13. Next the step of the operator letting down on said tubular member 24 being run into the main well bore casing 11 to allow the popped open orientation key 18 to guide and orient the tubular sleeve member 15 and the deflection member 16 into position by following the sill 20 of the window 13. Once the orientation key 18 reaches the down hole sill 52 or the key way 26 of the window, then fixingly and sealingly setting the tubular sleeve member 15 in the main well bore casing by continuing to let down on the drill sting 53 which is connected to the tubular member 24. by stab in 54 or any other connecting means. Once the tubular sleeve member 15 is fixed and sealed, then the step of controllable releasing the controllable releasing member 37 functionally holding the tubular member 24 and the tubular sleeve member 15 together is accomplished by letting down on the tubular member 24. Once released, continue letting down on the drill string 53 and tubular member 24 and/or any intermediate tubular goods until then the one orientation key 40 is in place and free for driving downward the tubular sleeve member 15 having an adjustable upper part 43 which is in mechanical communication with the aperture 21 for adjusting the aperture 21 until said controllably collapsible upper part 43 collapses which seals and sets the upper part of the tubular sleeve member 41 in the main well bore casing 11. After the tubular sleeve member 15 is sealed and set then continued lowering of the tubular member 24 into the deflector member 16 in the tubular sleeve member 15 to deflect the tubular member 24 through the window 13 for seating the sealing member 25 positioned about the tubular member 24 into seating with the seating surface 17 inside the tubular sleeve member 15 proximate the aperture 21 in the tubular sleeve member 15. Once the seating of the sealing member 25 with the seating surface 17 has occurred then pumping fluid 70 into the elastic tubular seal 50 through the tubular member 24 for sealing the window 13 and the lateral well bore 12. After the sealing is completed then pulling the deflector member 16 out of the tubular sleeve member 15 and out to the main well bore casing to leave a substantially clear and clean main well bore 11 with the lateral well bore 12 and main well bore casing sealed.

Between the steps of pumping fluid 70 into the elastic tubular seal 50 and pulling the deflector member 16 out of the tubular sleeve 15, may be the step of pressure testing the seal by pressuring up the well with well fluids 63, or other fluid, to check the seal. If the seal is not as secure as desired then re-running the step of pumping fluid 70 into the elastic tubular seal 50 may be done again to higher pressures, possibly if desired, and a re-pressure testing of the seal again until the seal is as desired. All of this rechecking being done while all the equipment for forming the seal remains in place, which eliminates any need to reset up the equipment if the seal had failed.

While the preferred embodiments of the invention and the methods of their use have been described for the assembly for forming a seal at the junction of a lateral well bore drilled through a window in at least a main well bore casing it will be appreciated that other embodiments and methods may be used without departing from the spirit of the invention.

What is claimed is:

1. An assembly for forming a seal at the junction of a lateral well bore drilled through a window at least a main well bore casing comprising a tubular means for being run into said well bore casing, at least one orientation means for orientation of said tubular means in said main well bore casing, a tubular sleeve means having an aperture through at least one side of said tubular sleeve means for being run into said well bore casing for alignment of said aperture with said window in said well bore casing and having a seating surface inside said tubular sleeve means proximate said aperture, a sealing means positioned about said tubular means for seating with said seating surface inside said tubular sleeve means proximate said aperture in said tubular sleeve means and for forming a seal when said sealing means is brought into engagement with said seating surface inside said tubular sleeve means proximate said aperture as said tubular means is run into said well bore and said lateral well bore, a deflection means positioned and releasably sealed in said tubular sleeve means for deflecting said tubular means through said window when said tubular means is run into contact with said deflection means, and at least one orientation means for orientation of said deflection means relative to said window in said at least one well bore casing for deflecting said tubular means through said window and for aligning said aperture through said at least one side of said tubular sleeve means with said window.

2. An assembly for forming a seal at the junction of a lateral well bore drilled through a window in at least a main well bore casing as in claim 1 further comprising, at least one slip grabbing means located on said tubular sleeve means and functionally connected to said at least one orientation means for orientation of said deflection means and for being set against said main well bore casing to prevent movement of said tubular sleeve means when said at least one orientation means for orientation of said deflection means has been fully oriented and set, at least one seal means located on said tubular sleeve means and functionally connected to said at least one orientation means for orientation of said tubular means in said main well bore casing and for being set in said main well bore casing to form a seal between said main well bore casing and said tubular sleeve means when said at least one orientation means for orientation of said tubular means has been fully oriented and set, at least one seal means located on said tubular sleeve means and functionally connected to said at least one orientation means for orientation of said deflection means for being set in said main well bore casing to form a seal between said main well bore casing and said tubular sleeve means when said at least one orientation means for orientation of said deflection means has been fully oriented and set.

3. An assembly for forming a seal at the junction of a lateral well bore drilled through a window in at least a main well bore casing as in claim 2 wherein said at least one orientation means for orientation of said deflection means relative to said window in said at least a well bore casing for deflecting said tubular means through said window further comprises, a key way means in said at least main well bore casing, and an outwardly biased key means for popping into said key way means in said at least a main well bore casing and guiding said outwardly biased key means along said key way means as said tubular sleeve means is lowered down hole and into position with said window and for activation and setting said seal means to form a seal between said tubular sleeve means and said well casing bore and for activation and setting said at least one slip grabbing means to prevent said tubular sleeve means from moving.

4. An assembly for forming a seal at the junction of a lateral well bore drilled through a window in at least a main well bore casing as in claim 3 wherein said key way means further comprises, a window key way means in communication with said window in said casing defined by a slot formed in said window sill in at least said main well bore casing for receiving said outwardly biased key means as said outwardly biased key means is moved along said window sill of said window as said tubular sleeve means is lowered down hole and into position with said window.

5. An assembly for forming a seal at the junction of a lateral well bore drilled through a window in at least a main well bore casing as in claim 3 further comprising, a compression sealing means connected to said sealing means positioned about said tubular means for sealing said seating surface inside said tubular sleeve means proximate said aperture in said tubular sleeve means against fluid communication there between.

6. An assembly for forming a seal at the junction of a lateral well bore drilled through a window in at least a main well bore casing as in claim 5 wherein said compression sealing means further comprises, an elastic tubular means and at least one-way check valve means connected in fluid communication with said elastic tubular means for receiving fluid to expand said elastic tubular means for forming a seal against said seating surface of said tubular sleeve means proximate said aperture.

7. An assembly for forming a seal at the junction of a lateral well bore drilled through a window in at least a main well bore casing as in claim 6 wherein said elastic tubular means further comprises, an expandable sealing means for receiving sufficient fluid to expand said elastic tubular means for forming a seal against said tubular sleeve means forming said aperture and against said tubular sleeve means outside and proximate said aperture for providing a seal which will prevent fluid movement either into or out of said aperture.

8. An assembly for forming a seal at the junction of a lateral well bore drilled through a window in at least a main well bore casing as in claim 7 wherein said sleeve means having an aperture through at least one side of said tubular sleeve means further comprising, adjustable section means formed in said tubular sleeve means on the up hole end of said tubular means for controlled compression of said tubular sleeve means outward for sealing said tubular sleeve means against said well bore casing and downward for adjustment of said aperture in said tubular sleeve means for bringing said seating surface inside said tubular sleeve means proximate said aperture into a configuration for mating with said sealing means positioned about said tubular means for seating.

9. An assembly for forming a seal at the junction of a lateral well bore drilled through a window in at least a main well bore casing as in claim 8 wherein said at least one orientation means for orientation of said tubular means further comprises, a mule shoe means located on said up hole end of said tubular sleeve means, a mule shoe key way means formed in said mule shoe means, and a key means functionally connected to said tubular means for engagement with said mule shoe means and for coming to rest in said key way means formed in said mule shoe means as said tubular means is run down into said well bore casing.

10. An assembly for forming a seal at the junction of a lateral well bore drilled through a window in at least a main well bore casing as in claim 9 wherein said key means connected to said tubular means further comprises, at least a controllable release means functionally connecting said key means to said tubular means for allowing downward motion to said tubular sleeve means and said tubular means and said sealing means positioned about said tubular means through said key means after said key means has oriented said tubular means and comes to rest in said key way means and for providing a controlled release of said at least a controllable release means from said key means after said tubular sleeve means is stopped from downward motion for allowing said tubular sleeve means to continue downward for putting said sealing means positioned about said tubular means in seating engagement with said seating surface inside said tubular sleeve means proximate said aperture.

11. An assembly for forming a seal at the junction of a lateral well bore drilled through a window in at least a main well bore casing as in claim 10 wherein said adjustable section means formed in said up hole end of said tubular sleeve means further comprises, controlled collapsible means formed in said tubular sleeve means on the up hole end of said tubular sleeve means for controlled compression of said tubular sleeve means outward for sealing said tubular sleeve means against said well bore casing and downward for adjustment of said aperture in said tubular sleeve means by bringing said seating surface inside said tubular sleeve means proximate said aperture into configuration for mating with said sealing means positioned about said tubular means for seating.

12. An assembly for forming a seal at the junction of a lateral well bore drilled through a window in at least a main well bore casing as in claim 11 wherein said adjustable section means formed in said up hole end of said tubular sleeve means further comprises, telescoping section means formed in said upper part of said tubular sleeve means on the up hole end of said tubular sleeve means for controlled compression of said tubular sleeve means outward for sealing said tubular sleeve means against said well bore casing and downward for adjustment of said aperture in said tubular sleeve means by bringing said seating surface inside said tubular sleeve means proximate said aperture into configuration for mating with said sealing means positioned about said tubular means for seating.

13. An assembly for forming a seal at the junction of a lateral well bore drilled through a window in at least a main well bore casing as in claim 11 wherein said controlled collapsible means formed in said up hole end of said tubular sleeve means further comprises, a metal compressible skeleton means, and a composite material means having said metal compressible skeleton means dispersed therein for controlled compression of said tubular sleeve means outward for sealing said tubular sleeve means against said well bore casing and downward for adjustment of said aperture in said tubular sleeve means by bringing said seating surface inside said tubular sleeve means proximate said aperture into configuration for mating with said sealing means positioned about said tubular means for seating.

14. An assembly for forming a seal at the junction of a lateral well bore drilled through a window in at least a main well bore casing as in claim 13 wherein said aperture in said tubular sleeve means further comprises, compressible material means connected about said aperture for sealing said tubular means when said aperture is downwardly adjusted.

15. An assembly for forming a seal at the junction of a lateral well bore drilled through a window in at least a main well bore casing comprising a tubular means for being run into said well bore casing, at least one orientation means for orientation of said tubular means in said main well bore casing, a tubular sleeve means having an aperture through at least one side of said tubular sleeve means and having a controllably collapsible upper part of said tubular sleeve means in mechanical communication with said aperture for being run into said well bore casing for alignment of said aperture with said window in said well bore casing and having a seating surface inside said tubular sleeve means proximate said aperture and, a sealing means positioned about said tubular means for seating with said seating surface inside said tubular sleeve means proximate said aperture in said tubular sleeve means and for forming a seal when said sealing means is brought into engagement with said seating surface inside said tubular sleeve means proximate said aperture as said tubular means is run into said well bore and into said lateral well bore, a deflection means positioned and releasably sealed in said tubular sleeve means for deflecting said tubular means through said window when said tubular means is run into contact with said deflection means, and at least one orientation means for orientation of said deflection means relative to said window in said at least one well bore casing for deflecting said tubular means through said window and for aligning said aperture through said at least one side of said tubular sleeve means with said window.

16. An assembly for forming a seal at the junction of a lateral well bore drilled through a window in at least a main well bore casing as in claim 15 further comprising, a releasable connector means for functionally connecting said tubular means for being run into said well bore casing and said tubular sleeve means and said deflection means together for being run into said well bore casing as a unitized assembly.

17. An assembly for forming a seal at the junction of a lateral well bore drilled through a window in at least a main well bore casing as in claim 16 further comprising, slip grabbing means located down hole on said tubular sleeve means and functionally connected to said at least one orientation means for orientation of said deflector means for being set against said main well bore casing to prevent movement of said tubular sleeve means when said at least one orientation means for orientation of said deflection means has been fully oriented and set, at least one seal means located on said tubular sleeve means and functionally connected to said at least one orientation means for orientation of said tubular means in said main well bore casing and for being set in said main well bore casing to seal said main well bore casing and said tubular sleeve means above said seal means when said at least one orientation means for orientation of said tubular means has been fully oriented and set and, at least one packer seal means located on said tubular sleeve means and functionally connected to said at least one orientation means for orientation of said deflection means for being set in said main well bore casing to form a seal between said main well bore casing and said tubular sleeve means when said at least one orientation means for orientation of said deflection means has been fully oriented and set.

18. An assembly for forming a seal at the junction of a lateral well bore drilled through a window in at least a one main well bore casing as in claim 17 wherein said at least one orientation means for orientation of said deflection means relative to said window in said at least well bore casing for deflecting said tubular means through said window further comprises, a key way means formed in communication with said window on said at least main well bore, and an outwardly biased key means for popping into said window in said at least a main well bore casing and said window guiding said outwardly biased key means to said key way means as said tubular sleeve means is lowered down hole and into position with said window and for activation and setting said seal means to seal off said tubular sleeve means from said well casing bore down hole of said seal means and for activation and setting said slip grabbing means to prevent said tubular sleeve means from moving.

19. An assembly for forming a seal at the junction of a lateral well bore drilled through a window in at least a main well bore casing as in claim 18 wherein said key way means further comprises, a slot means opening in communication with said window in the at least a main well bore casing for receiving said outwardly baised key means as said tubular sleeve means is lowered down hole and into position with said window.

20. An assembly for forming a seal at the junction of a lateral well bore drilled through a window in at least a main well bore casing as in claim 19 further comprising, a compression sealing means connected to said sealing means positioned about said tubular means for sealing said seating surface inside said tubular sleeve means proximate said aperture in said tubular sleeve means against fluid communication.

21. An assembly for forming a seal at the junction of a lateral well bore drilled through a window in at least a main well bore casing as in claim 20 wherein said compression sealing means further comprises, an elastic tubular means and at least one way check value means connected in fluid communication with said elastic tubular means for receiving fluid to expand said elastic tubular means for forming a seal against said seating surface of said tubular sleeve means proximate said aperture.

22. An assembly for forming a seal at the junction of a lateral well bore drilled through a window in at least a main well bore casing as in claim 21 wherein said elastic tubular means further comprises, a compression sealing means for receiving sufficient fluid to expand said elastic tubular means for forming a seal against said tubular sleeve means forming said aperture and against said tubular sleeve means outside and proximate said aperture for providing a seal which will prevent fluid movement either into or out of said aperture.

23. An assembly for forming a seal at the junction of a lateral well bore drilled through a window in at least a main well bore casing as in claim 22 wherein said at least one orientation means for orientation of said tubular means further comprises, a mule shoe means located on said up hole end of said tubular sleeve means, a mule shoe key way means formed in said mule shoe means, and a key means functionally connected to said tubular means for engagement with said mule shoe means and for coming to rest in said key way means formed in said mule shoe means as said tubular means is run into said well bore casing.

24. An assembly for forming a seal at the junction of a lateral well bore drilled through a window in at least a main well bore casing as in claim 23 wherein said key means connected to said tubular means further comprises, at least one controllable release means functionally connecting said key means to said tubular means for allowing downward motion to said tubular sleeve means and said tubular means and said sealing means positioned about said tubular means through said key means after said key means has oriented said tubular means and comes to rest in said key way means and for providing a controlled break from said key means after said tubular sleeve means is stopped from downward motion for allowing said tubular means to continue downward for putting said sealing means positioned about said tubular means in seating engagement with said seating surface inside said tubular sleeve means proximate said aperture.

25. An assembly for forming a seal at the junction of a lateral well bore drilled through a window in at least a main well bore casing as in claim 15 wherein said upper part of said tubular sleeve means having a controllable collapsible upper part in mechanical communication with said aperture further comprises, controlled collapsible means formed in said upper part of said tubular sleeve means on the up hole end of said tubular sleeve means for controlled compression of said tubular sleeve means outward for sealing said tubular sleeve means against said well bore casing and downward for adjustment of said aperture in said tubular sleeve means by bringing said seating surface inside said tubular sleeve means proximate said aperture into configuration for mating with said sealing means position about said tubular means for seating.

26. An assembly for forming a seal at the junction of a lateral well bore drilled through a window in at least a main well bore casing as in claim 15 wherein said upper part of said tubular sleeve means having a controllable collapsible upper part in mechanical communication with said aperture further comprises, telescoping section means formed in said tubular sleeve means on the up hole end of said tubular sleeve means for controlled compression of said tubular sleeve means outward for sealing said tubular sleeve means against said well bore casing and downward for adjustment of said aperture inside said tubular sleeve means for bringing said seating surface inside said tubular sleeve means proximate said aperture and into configuration for mating with said sealing means position about said tubular means for seating.

27. An assembly for forming a seal at the junction of a lateral well bore drilled through a window in at least a main well bore casing as in claim 26 wherein said controlled collapsible means formed in said upper part of said tubular sleeve means further comprises, a metal compressible skeleton means, and a composite material means having said metal compressible skeleton means dispersed therein for controlled compression of said tubular sleeve means outward for sealing said tubular sleeve means against said well bore casing and downward for adjustment of said aperture in said tubular sleeve means by bringing said seating surface inside said tubular sleeve means proximate said aperture into configuration for mating with said sealing means positioned about said tubular means for seating.

28. An assembly for forming a seal at the junction of a lateral well bore drilled through a window in at least a main well bore casing as in claim 26 wherein said at least one orientation means for orientation of said tubular means further comprises, a mule shoe means located on said up hole end of said tubular sleeve means, a key way means formed in said mule shoe means, and a key means functionally connected to said tubular means for engagement with said mule shoe means and for coming to rest in said key way formed in said mule shoe means.

29. An assembly for forming a seal at the junction of a lateral well bore drilled through a window in at least a main well bore casing as in claim 28 wherein said key means connected to said tubular means further comprises, at least one shear pin means functionally connecting said key means to said tubular means for allowing continued downward motion for said tubular sleeve means and said tubular means and said sealing means positioned about said tubular means after said key means has oriented said tubular means and for providing a controlled break of said at least one shear pin means from said key means after said tubular means is stopped from downward motion to allow said tubular means continued downward for putting said sealing means in position about said tubular means in seating engagement with said seating surface inside said tubular sleeve means proximate said aperture.

30. A method of forming a seal at the junction of a lateral well bore drilled through a window in at least a main well bore casing comprising the steps of;

running a tubular means with a sealing means positioned about said tubular means into said well bore casing which is releasably and functionally connected to a tubular sleeve means having an aperture through at least one side of said tubular sleeve means, with a deflection means positioned therein and releaseably sealed in said tubular sleeve means and an orientation means, popping outwardly open said orientation means for orientation of said deflection means in said window in said well bore casing when said orientation means reaches the opening of said window, letting down on said tubular means being run into said well bore casing to allow said popped open orientation means to guide and orient said tubular sleeve means and said deflection means into position by following said window formed in said main well bore casing, setting said tubular sleeve in a fixed and sealed position in said well bore, controllable releasing said tubular means and said tubular sleeve means by continuing to let down on said tubular means, letting down on said tubular means and said one orientation means for orientation of said tubular means in said main well bore casing and for driving downward said tubular sleeve means having an adjustable upper part in mechanical communication with said aperture for adjusting said aperture and until said controllably collapsible upper part of said tubular sleeve means collapses and seals said upper part of said tubular sleeve means in said wellbore, releasing said controllable releasing means holding said orientation means for orientation of said tubular means, lowering said tubular means on to said deflection means in said tubular sleeve means to deflect said tubular means through said window, seating said sealing means positioned about said tubular means proximate said aperture in said tubular sleeve means, pumping fluid into said compression sealing means through said tubular means for sealing said window and lateral well bore, and pulling said deflector means out of said tubular sleeve means and out of said well bore to leave a substantially clear and clean well bore with said lateral well bore and main well bore sealed and connected.

31. A method of forming a seal at the junction of a lateral well bore drilled through a window in at least a main well bore casing of claim 30 further comprising;

pressuring up said well bore after pumping fluid in to said compression sealing means through said tubular means for sealing said window and lateral well bore for testing the quality of said seal before pulling said deflector means out of said tubular sleeve means.

32. A method of forming a seal at the junction of a lateral well bore drilled through a window in at least a main well bore casing comprising the steps of;

running a tubular means with a sealing means positioned about said tubular means into a well bore casing functionally shear pinned to a tubular sleeve means having an aperture through at least one side of said tubular sleeve means, with a deflection means positioned therein and releasable sealed in said tubular sleeve means and an orientation means connected thereto, popping open said orientation means for orientation of said deflection means in said window in said well bore casing when said orientation means reaches the opening of said window, letting down on said tubular means being run into said well bore casing to allow said popped open orientation means to guide and orient said tubular sleeve means and said deflection means into position by following said window sill, setting said tubular sleeve means in said well bore, shearing shear pins functionally holding said tubular means and said tubular sleeve means together by continuing to let down on said tubular means, letting down on said tubular means and said one orientation means for orientation of said tubular means in said main well bore casing for driving downward said tubular sleeve means having an aperture and until said controllably collapsible upper part collapses and seals said tubular sleeve means in said wellbore, shearing shear pin holding said orientation means for orientation of said tubular means, lowering said tubular means on to said deflector means in said tubular sleeve means to deflect said tubular means through said window, seating said sealing means positioned about said tubular means for seating with said seating surface inside said tubular sleeve means proximate said aperture in said tubular sleeve means, pumping fluid into said compression sealing means through said tubular means for sealing said window and lateral well bore, and pulling said deflector means out of said tubular sleeve means and out of said well bore to leave a substantially clear and clean well bore with said lateral well bore and main well bore sealed and connected.

33. A method of forming a seal at the junction of a lateral well bore drilled through a window in at least a main well bore casing of claim 32 further comprising;

pressuring up said well bore after pumping fluid in to said compression sealing means through said tubular means for sealing said window and lateral well bore for testing the quality of said seal before pulling said deflector means out of said tubular sleeve means, pumping additional fluid into said compression sealing means through said tubular means for correcting said seal between said window and lateral well bore.

* * * * *